US008175474B2

(12) United States Patent
Kinukawa et al.

(10) Patent No.: US 8,175,474 B2
(45) Date of Patent: May 8, 2012

(54) IMAGE FORMING APPARATUS WITH DYNAMIC CHARACTERISTIC CALCULATION

(75) Inventors: Tatsuya Kinukawa, Mishima (JP); Yoshiro Saito, Susono (JP); Tomoaki Nakai, Numazu (JP); Kazuhiro Funatani, Mishima (JP); Hiroyuki Seki, Mishima (JP); Kimitaka Ichinose, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 418 days.

(21) Appl. No.: 12/470,619

(22) Filed: May 22, 2009

(65) Prior Publication Data

US 2009/0297190 A1 Dec. 3, 2009

(30) Foreign Application Priority Data

May 27, 2008 (JP) ..... 2008-138781

(51) Int. Cl.
*G03G 15/00* (2006.01)
*G03G 15/20* (2006.01)

(52) U.S. Cl. ..... 399/49; 399/308

(58) Field of Classification Search ..... 399/49, 399/302, 308

See application file for complete search history.

(56) References Cited

U.S. PATENT DOCUMENTS 6,658,221 B2 * 12/2003 Hama et al. ..... 399/49
6,909,858 B2 * 6/2005 Hama et al. ..... 399/49
6,985,678 B2 1/2006 Maebashi et al.
2007/0036568 A1 * 2/2007 Shida ..... 399/49
2007/0231021 A1 10/2007 Kinoshita et al.
2007/0237533 A1 10/2007 Hanashi et al.
2009/0296147 A1 12/2009 Kinukawa et al.
2009/0297191 A1 12/2009 Hirai et al.

FOREIGN PATENT DOCUMENTS

CN 1083646 A 3/1994
JP 10-288880 A 10/1998
JP 11-038707 A 2/1999
JP 2002-214854 A 7/2002
JP 2006-150627 A 6/2006

OTHER PUBLICATIONS

Notification of the First Office Action dated Mar. 2, 2011, in Chinese Application No. 200910145658.0.
Communication dated Aug. 14, 2009, forwarding a Search Report in counterpart European Application No. 09158797.2-1240.

* cited by examiner

*Primary Examiner* — Sandra Brase
(74) *Attorney, Agent, or Firm* — Fitzpatrick, Cella, Harper & Scinto

(57) ABSTRACT

There is provided an image forming apparatus that accurately obtains the dynamic characteristic of the apparatus when a foreign substance is adhered to a driving roller for driving an endless belt, such as a facing roller. To accomplish this, the image forming apparatus uses an optical sensor to detect information of a foreign substance on the facing roller. When it is determined that there is no foreign substance information, the image forming apparatus executes profile detection of an intermediate transfer belt using the nominal circumference of the facing roller. When the optical sensor detects foreign substance information, the image forming apparatus measures the circumference of the facing roller, and performs profile detection of the intermediate transfer belt using the measured circumference of the facing roller.

11 Claims, 25 Drawing Sheets

IMAGE FORMING APPARATUS WITH DYNAMIC CHARACTERISTIC CALCULATION

BACKGROUND OF THE INVENTION

1. Field of the Invention

The present invention relates to an image forming apparatus such as a copying machine, printer, or facsimile apparatus which forms an image by an electrophotographic method.

2. Description of the Related Art

These days, image forming apparatuses using the electrophotographic method are achieving higher speeds and higher qualities. In particular, color image forming apparatuses require accurate color reproduction and tint stability, and generally have a function of automatically controlling the image density.

In image density calibration control, an image density detector incorporated in an image forming apparatus detects a plurality of test toner images (patches) which are formed on an image carrier while changing image forming conditions. The detected toner images are converted into a substantial amount of toner adhesion, and optimum image forming conditions are decided based on the conversion result.

A plurality of types of image density calibration control operations is generally executed to obtain optimum values for a plurality of types of image forming conditions. The types of image forming conditions include conditions such as the charging voltage, exposure intensity, and developing voltage, and a lookup table setting used to convert a signal input from the host into output image data when forming a halftone image. The tint varies depending on a change of the environment where an image forming apparatus is used, the use log of various consumables, and the like. The image density calibration control needs to be periodically executed to always stabilize the tint.

According to the detection principle of an optical image density detector, a light receiving element receives light which is emitted from a light emitting element and reflected by a patch or image carrier itself. The amount of toner adhered to the patch is calculated from the received light. Conversion into a substantial amount of toner adhesion is executed based on the relationship between an output from the light receiving element when no toner is adhered to the image carrier, and an output from the light receiving element when toner is adhered to the image carrier.

The reflectance of the image carrier surface changes depending on the position of the image carrier. To calculate the amount of toner adhesion with high precision, outputs in the presence and absence of toner need to be acquired at the same position on the image carrier. In general, a background output VB from the light receiving element in the absence of toner is acquired at a specific position. Then, the image carrier rotates at least one round. A patch is formed at the same position to acquire a patch output VP from the light receiving element. The background output VB corresponds to light reflected by the background of the image carrier. The patch output VP corresponds to light reflected by the patch. Specifying the position on the image carrier requires the circumference of the image carrier. This is because the time taken for a specific position on the image carrier to rotate is obtained by dividing the circumference by the circumferential speed (process speed) of the image carrier.

However, the circumference of the image carrier changes depending on variations of components, the environment of the image forming apparatus, and the like. If the circumference is used as a fixed value, an error occurs in specifying a position. To prevent this, information associated with the circumference of the image carrier needs to be measured dynamically.

There is proposed the following method for an image forming apparatus which employs an intermediate transfer method. More specifically, a mark is attached to the surface of an intermediate transfer member. An optical sensor receives light reflected by the mark to measure the circumference of an image carrier. The mark is attached not to an image-formed surface used for image formation, but to a longitudinal end on the intermediate transfer member.

Japanese Patent Laid-Open No. 2002-214854 proposes the following technique based on the fact that the intermediate transfer belt rotates one round every time the driving roller for driving the intermediate transfer belt rotates 5.2 times. More specifically, the eccentric component of the facing roller cycle is obtained. A cycle profile reflecting thickness nonuniformity of the intermediate transfer belt is attained from the eccentric component. The facing roller is arranged to face an optical sensor via a driven belt. In Japanese Patent Laid-Open No. 2002-214854, accurate density detection is done based on the attained cycle profile. In this manner, there has conventionally been known a technique of obtaining, in consideration of the influence of a driving roller, the dynamic characteristic (e.g., density characteristic) of an apparatus that may vary owing to aging factors and environmental factors.

However, the conventional technique considers the eccentric component of a driving roller, but suffers the following problems. For example, when the image forming apparatus operates for a long time, mold dust and transfer roller dust are generated upon wear. Such a foreign substance may enter the gap between the facing roller and the image carrier, and be adhered to the facing roller. If the image carrier is irradiated with light to detect the reflected light in this state, the influence of the foreign substance appears in the detection result every time the facing roller rotates once.

The foreign substance adhered to the facing roller adversely affects the detection result of light coming from a detection target. This inhibits obtaining an accurate light detection result or an accurate dynamic characteristic of the apparatus that is calculated from the light detection result.

SUMMARY OF THE INVENTION

The present invention enables realization of an image forming apparatus which accurately obtains the dynamic characteristic of the apparatus when a foreign substance is adhered to a driving roller for driving an endless belt, such as a facing roller.

One aspect of the present invention provides an image forming apparatus that forms a toner image on an endless belt driven by a driving roller, the apparatus comprising: a detector that detects light from the endless belt or the toner image formed on the endless belt; a determination unit that determines whether a foreign substance is adhered to the driving roller; a decision unit that, in the case where the determination unit determines that the foreign substance is adhered, decides a moving amount of a surface of the endless belt when the driving roller rotates once by a first decision method deciding the moving amount and corresponding to a case wherein the foreign substance is adhered, and in the case where the determination unit determines that no foreign substance is adhered, decides the moving amount by a second decision method deciding the moving amount and corresponding to a case wherein no foreign substance is adhered; and a calculator that calculates a dynamic characteristic of the image forming apparatus based on a detection result of the detector that complies with the moving amount decided by the decision unit according to the first decision method or the second decision method.

Another aspect of the present invention provides an image forming apparatus that forms a toner image on an endless belt driven by a driving roller, the apparatus comprising: an update unit that updates a moving amount of a surface of the endless belt when the driving roller rotates once, the moving amount being stored in advance in a storage unit of the image forming apparatus; and a calculator that calculates a dynamic characteristic of the image forming apparatus based on the moving amount updated by the update unit.

Still another aspect of the present invention provides an image forming apparatus that forms a toner image on an endless belt driven by a driving roller, the apparatus comprising: a first detector and second detector that detect light reflected by a surface of the endless belt; a determination unit that determines, based on detection results of the first detector and the second detector, whether a foreign substance is adhered to the driving roller; and a calculator that causes a detector which obtains a detection result from which the determination unit determines that no foreign substance is adhered, to detect light reflected by the surface of the endless belt, and calculate a dynamic characteristic of the image forming apparatus based on the detection result of the detector.

Further features of the present invention will be apparent from the following description of exemplary embodiments with reference to the attached drawings.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

The first embodiment will be explained with reference to FIGS. 1 to 15. In the first embodiment, the present invention is applied to a color image forming apparatus. The present invention is also applicable to a monochrome image forming apparatus. The image forming apparatus is, for example, a printer, copying machine, multi-functional peripheral, or facsimile apparatus. The first embodiment will exemplify an intermediate transfer method. The intermediate transfer method forms a toner image on a drum-like image carrier, preliminarily transfers the toner image to an intermediate transfer member (intermediate transfer belt), and secondarily transfers the toner image from the intermediate transfer member to a printing material. The printing material is also called, for example, a transfer material, printing medium, paper, sheet, or transfer paper.

[Image Forming Apparatus System]

Figure 1:
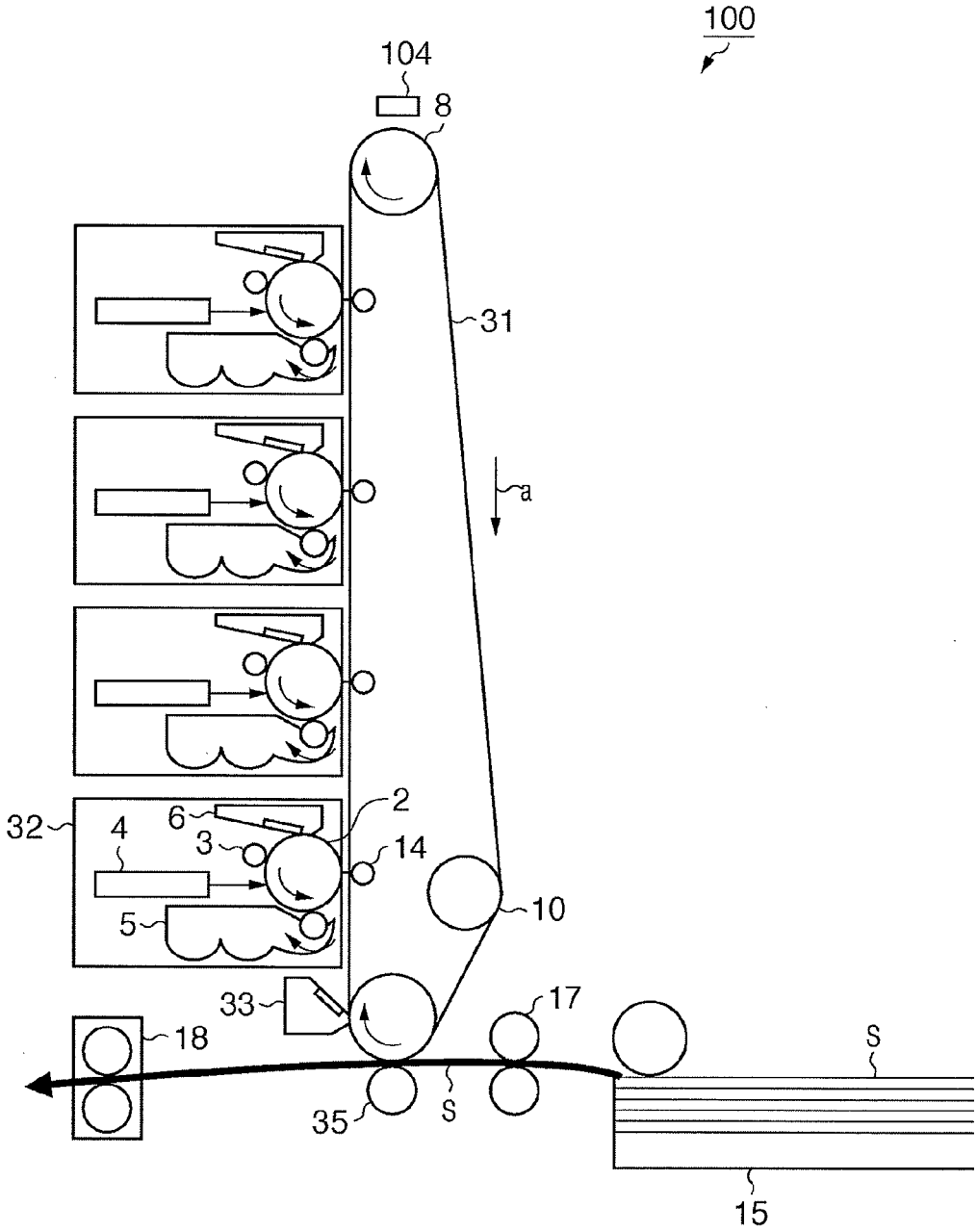
FIG. 1 is a schematic sectional view of a color image forming apparatus according to the first embodiment.

FIG. 1 is a schematic sectional view of a color image forming apparatus according to the first embodiment. The color image forming apparatus includes four image forming stations corresponding to Y (Yellow), M (Magenta), C (Cyan), and Bk (Black) toners. For descriptive convenience, the image forming stations have a common arrangement except for the color of the developer (toner).

Each process cartridge 32 includes a photosensitive drum 2, charger 3, exposure unit 4, developing unit 5, and cleaning blade 6. Toner images of different colors formed by the process cartridges (image forming stations) 32 are primarily transferred in series onto an intermediate transfer belt 31 by primary transfer rollers 14. The intermediate transfer belt 31 is an example of a rotation member used for image formation. A secondary transfer roller 35 secondarily transfers, onto a printing material S, a multicolor image formed on the intermediate transfer belt 31. The printing material S is conveyed from a paper feed unit 15. Then, a fixing unit 18 fixes the multicolor image onto the printing material S. A cleaner 33 recovers toner left on the intermediate transfer belt 31.

The photosensitive drum 2 is a rotary drum type electrophotographic photosensitive body used repetitively. The photosensitive drum 2 is driven to rotate at a predetermined circumferential speed (process speed). The process speed is, for example, 180 mm/sec. The primary charging roller of the primary charger 3 uniformly charges the photosensitive drum 2 to a predetermined polarity and potential. The exposure unit 4 includes a laser diode, polygon scanner, lens unit, and the like. The exposure unit 4 exposes the photosensitive drum 2 to an image, forming an electrostatic latent image on the photosensitive drum 2.

The developing unit 5 executes developing processing to adhere toner to an electrostatic latent image formed on the image carrier. The developing roller of the developing unit 5 is arranged in contact with the photosensitive drum 2 while rotating in the forward direction with respect to the photosensitive drum 2.

A driving roller 8 drives the intermediate transfer belt 31 to rotate in contact with the respective photosensitive drums 2 at almost the same circumferential speed as that of the photosensitive drums 2. The intermediate transfer belt 31 is formed from, for example, an endless film member about 50 to 150 μm thick at a volume resistivity of, for example, 10E8 to 10E12 Ωcm. For example, an image-formed surface (to be referred to as a surface hereinafter) used for image formation on the intermediate transfer belt 31 has a relatively high reflectance for black. The intermediate transfer belt 31 expands and contracts in accordance with the tolerance (about ±1.0 mm with respect to an ideal dimension value) in manufacturing the belt, and variations dependent on the temperature and humidity of the use environment (the intermediate transfer belt 31 varies by about 5 mm in an environment of 15° C. and 10% to that of 30° C. and 80%). However, a tension roller 10 keeps the intermediate transfer belt 31 taut, so the intermediate transfer belt 31 can rotate normally even if the circumference varies.

The primary transfer roller 14 is a solid rubber roller whose resistance is adjusted to 10E7 to 10E9Ω. The cleaning blade 6 removes and recovers toner left on the photosensitive drum 2 after primary transfer.

The printing material S fed from the paper feed unit 15 is conveyed toward the nip between the intermediate transfer belt 31 and the secondary transfer roller 35 by a pair of registration rollers 17 driven to rotate at a predetermined timing. A toner image on the intermediate transfer belt 31 is transferred to the printing material S by the action of static electricity generated by a high voltage applied to the secondary transfer roller 35.

[Control Arrangement of Image Forming Apparatus]

Figure 2:
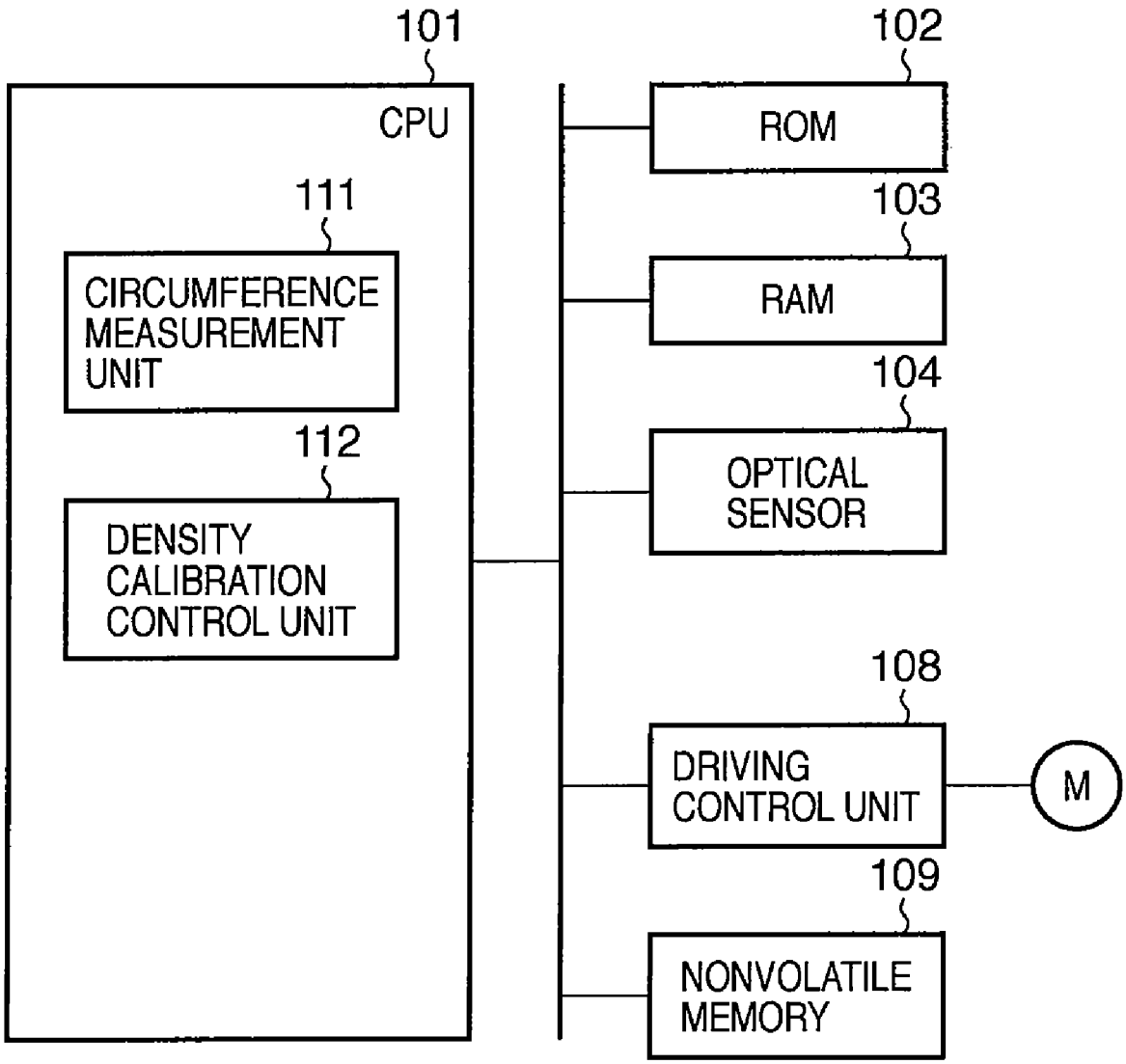
FIG. 2 is a block diagram showing an example of a control unit according to the first embodiment.

FIG. 2 is a block diagram showing an example of a control unit according to the first embodiment. A CPU 101 controls each unit of the image forming apparatus based on a variety of control programs stored in a ROM 102 by using a RAM 103 as a work area. The ROM 102 stores various control programs, various data, tables, and the like. The RAM 103 provides a program loading area, a work area for the CPU 101, various data storage areas, and the like. As characteristic functions, the CPU 101 in FIG. 2 includes a circumference measurement unit 111 and density calibration control unit 112.

A driving control unit 108 controls motors for driving the photosensitive drum 2, charger 3, exposure unit 4, developing unit 5, and intermediate transfer belt 31, and the charging bias, developing bias, and the like in accordance with instructions from the CPU 101.

A nonvolatile memory 109 is a storage which saves a variety of data such as light quantity setting data and information associated with the circumference of the intermediate transfer belt 31 which are used to execute image density calibration control.

The circumference measurement unit 111 measures the circumference of the intermediate transfer belt 31 based on data acquired by an optical sensor 104 from the intermediate transfer belt 31. The circumference measurement unit 111 is an example of a calculator which calculates information associated with the actual circumference of a rotation member. Information associated with the actual circumference means information for graphing the circumference of a rotation member that varies owing to any cause. This information is necessary to specify/detect, after a certain time, the same position as a given position at a given timing while the rotation member rotates. An example of this information is a length ($X_{profile\ result}$ to be described later) by which the rotation member expands or contracts over time from the nominal circumference (ideal dimension value free from any manufacturing tolerance or environmental variations) of the rotation member. Another example is actual circumference information (actual circumference given by equation (5) to be described later) of one round of the rotation member. The entity of the information may also be digital data (count value) representing the time, or digital data (count value) representing the length.

The density calibration control unit 112 adjusts image forming conditions using the quantity of light reflected by a patch image that is acquired using the optical sensor 104 for density calibration control, and obtained information associated with the actual circumference of the intermediate transfer belt 31.

The first embodiment will exemplify a case wherein the CPU 101 executes circumference measurement and density calibration control. However, the present invention is not limited to this. For example, when an image forming apparatus incorporates an ASIC (Application Specific Integrated Circuit) or SOC (System On Chip), the ASIC or SOC may also execute part or all of circumference measurement processing and density calibration control processing. The SOC is a chip which integrates a CPU and ASIC into a single package. When the ASIC executes circumference measurement and density calibration control, this can reduce the processing load on the CPU 101.

[Optical Sensor]

Figure 3:
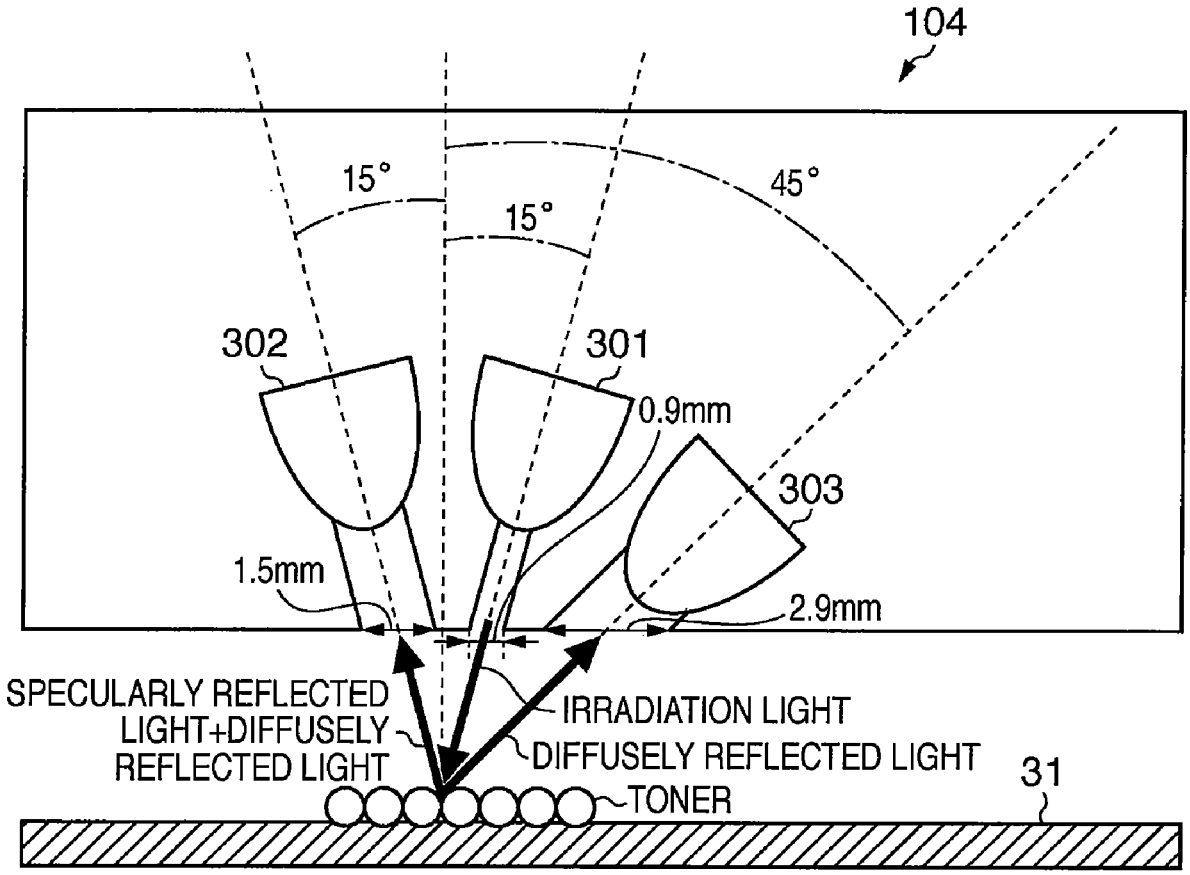
FIG. 3 is a view showing an example of an optical sensor 104.

FIG. 3 is a view showing an example of the optical sensor 104. The optical sensor 104 includes a light emitting element 301 such as an LED, two light receiving elements 302 and 303 such as photodiodes, and a holder. For example, the light emitting element 301 emits infrared light (wavelength: 950 nm) to a patch on the intermediate transfer belt 31 or the background. The light receiving elements 302 and 303 measure the quantity of light reflected by the patch or background. The density calibration control unit 112 of the CPU 101 calculates the amount of toner adhesion based on the reflected light quantity obtained by the optical sensor 104.

Light reflected by the patch or background contains a specularly reflected component and diffusely reflected component. The light receiving element 302 detects both specularly and diffusely reflected components. The light receiving element 303 detects only a diffusely reflected component. When toner adheres to the intermediate transfer belt 31, it cuts off light, decreasing specularly reflected light. That is, an output from the light receiving element 302 decreases.

A black toner absorbs 950-nm infrared light used in the embodiment, and yellow, magenta, and cyan toners diffusely reflect it. Hence, a larger amount of toner adhesion to the intermediate transfer belt 31 increases an output from the light receiving element 303 as for yellow, magenta, and cyan toners. The light receiving element 302 is also influenced by a large amount of toner adhesion. That is, even when yellow, magenta, and cyan toners completely shield the intermediate transfer belt 31 from light, an output from the light receiving element 302 still remains.

The first embodiment sets the irradiation angle of the light emitting element 301 to 15°, the light receiving angle of the light receiving element 302 to 15°, and that of the light receiving element 303 to 45°. These angles are defined by optical axes and the perpendicular of the intermediate transfer belt 31. The aperture diameter of the light receiving element 302 is set smaller than that of the light receiving element 303 in order to minimize the influence of the diffusely reflected component. For example, the aperture diameter of the light emitting element 301 is 0.9 mm, that of the light receiving element 302 is 1.5 mm, and that of the light receiving element 303 is 2.9 mm. The aperture diameter of the light emitting element 301 is set small to place importance on detection accuracy of a positional shift detection mark when the light emitting element 301 is shared between detection of a density calibration control patch image and detection of a positional shift detection mark. When detecting reflected one of light emitted from the light emitting element 301, even a relatively local density variation can be detected at high sensitivity.

A typical example of the optical sensor 104 has been described. However, it will readily occur to those skilled in the art that the optical sensor 104 can be implemented by various well-known types of sensors such as one using infrared light as irradiation light.

[Necessity of Image Density Calibration Control]

In an image forming apparatus 100, the optical sensor 104 serving as an optical detector is arranged to face the intermediate transfer belt 31. Generally in an electrophotographic color image forming apparatus, the electrical characteristics of each unit and printing material, and the attraction force to toner change under various conditions such as exchange of consumables, change of the environment (e.g., change of the temperature or humidity, or degradation of the apparatus), and the number of printed sheets. A change of the characteristics appears as variations of the image density or a change of color reproduction. Such variations obstruct obtaining accurate original color reproduction.

In the first embodiment, to always obtain accurate color reproduction, a plurality of patches (toner images) is formed as test images while changing image forming conditions in a no-image forming state. The optical sensor 104 detects the densities of these patches. The no-image forming state means a state in which a general document or the like created by a user is not formed. Based on the detection result, the density calibration control unit 112 executes image density calibration control. Factors which influence the image density are the charging bias, developing bias, exposure intensity, lookup table, and the like. The first embodiment will exemplify a case wherein image forming conditions are adjusted by correcting a lookup table. A concrete operation of image density calibration control will be described later.

[Necessity of Measuring Information Associated with Actual Circumference]

Figure 4:
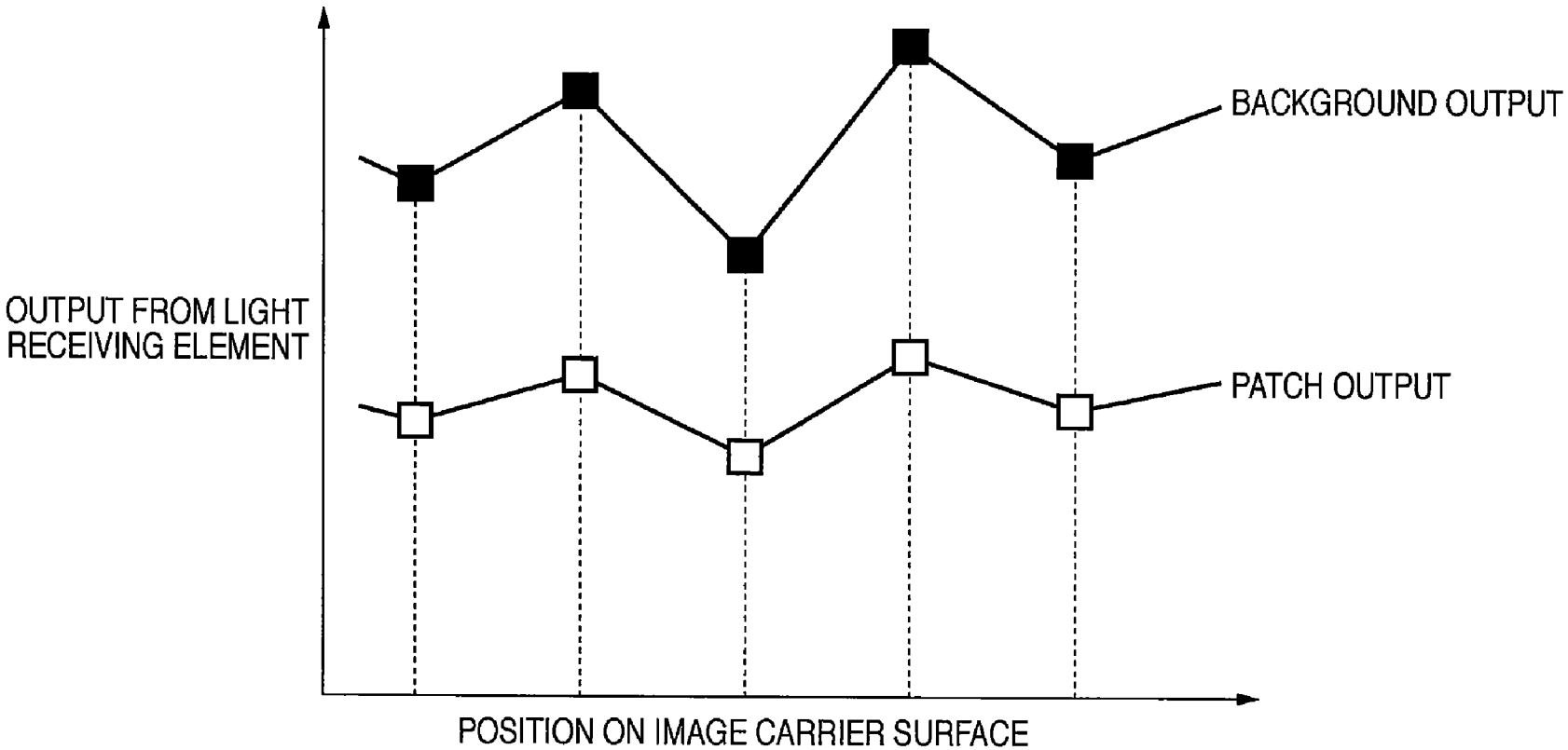
FIG. 4 is a graph exemplifying variations of background outputs and those of patch outputs at a plurality of positions on an intermediate transfer belt.

FIG. 4 is a graph exemplifying variations of background outputs and those of patch outputs at a plurality of positions on the intermediate transfer belt. Patches are toner images formed at the same halftone density. A background output represents a reflected light quantity detected by the light receiving element 302 when no patch is formed on the intermediate transfer belt. A patch output represents a reflected light quantity detected by the light receiving element 302 when a patch is formed on the intermediate transfer belt. As shown in FIG. 4, an output from the light receiving element 302 is influenced by the surface reflectance of the intermediate transfer belt 31 serving as an image carrier (rotation member) in the embodiment. For this reason, patch output values differ from each other though patches are formed at the same density. This also applies to the light receiving element 303.

If image density calibration control is executed under the influence of the reflectance of the background of the intermediate transfer belt 31, density data of a printed halftone image and outputs from the light receiving elements 302 and 303 have a diminished correlation to each other. As a result, the precision of image density calibration control decreases. To cancel the influence of the reflectance of the surface of the intermediate transfer belt 31, it is necessary to measure reflected light beams received by the light receiving elements 302 and 303 in the presence and absence of toner at the same position on the intermediate transfer belt 31. A calculation method of canceling the influence of the reflectance of the surface (background) of the intermediate transfer belt 31 will be described later.

The circumference of the intermediate transfer belt 31 varies in accordance with the manufacturing tolerance, environment, and paper durability (long-term operation of the apparatus). To measure reflected light beams corresponding to the presence and absence of toner at the same position on the intermediate transfer belt 31, the circumference of the intermediate transfer belt 31 needs to be grasped accurately. The time taken for an arbitrary position to rotate one round can be calculated based on a circumference upon expansion/contraction or the expansion and contraction amount, and the process speed as long as a circumference upon expansion/contraction, or the amount by which the intermediate transfer belt expands or contracts can be measured. The calculated time taken for an arbitrary position to rotate one round corresponds to a cycle in which the arbitrary position on the intermediate transfer belt 31 passes through the detection point of the optical sensor 104. From this, when the timer measures the cycle of the intermediate transfer belt 31, the count value of the timer represents an absolute position on the intermediate transfer belt. A detailed mechanism of circumference measurement in the first embodiment will be described later. An arbitrary position in the first embodiment includes even a position where measurement starts when, for example, a plurality of measurement start timings is determined in advance and a measurement start timing closest to input of a measurement start instruction has come. The following description will use an "arbitrary position" and "arbitrary timing", which include the above-described meaning. In the following description, the dynamic characteristic of the apparatus means a characteristic of the apparatus that may vary owing to an aging or secular factor or an environmental factor (e.g., temperature or humidity), like the above-described circumference of the intermediate transfer belt 31.

[Image Density Calibration Control]

A concrete example of image density calibration control in the first embodiment will be explained with reference to FIGS. 5 and 6. The CPU 101 executes the following processing by loading a control program stored in the ROM 102 into the RAM 103.

Figure 5:
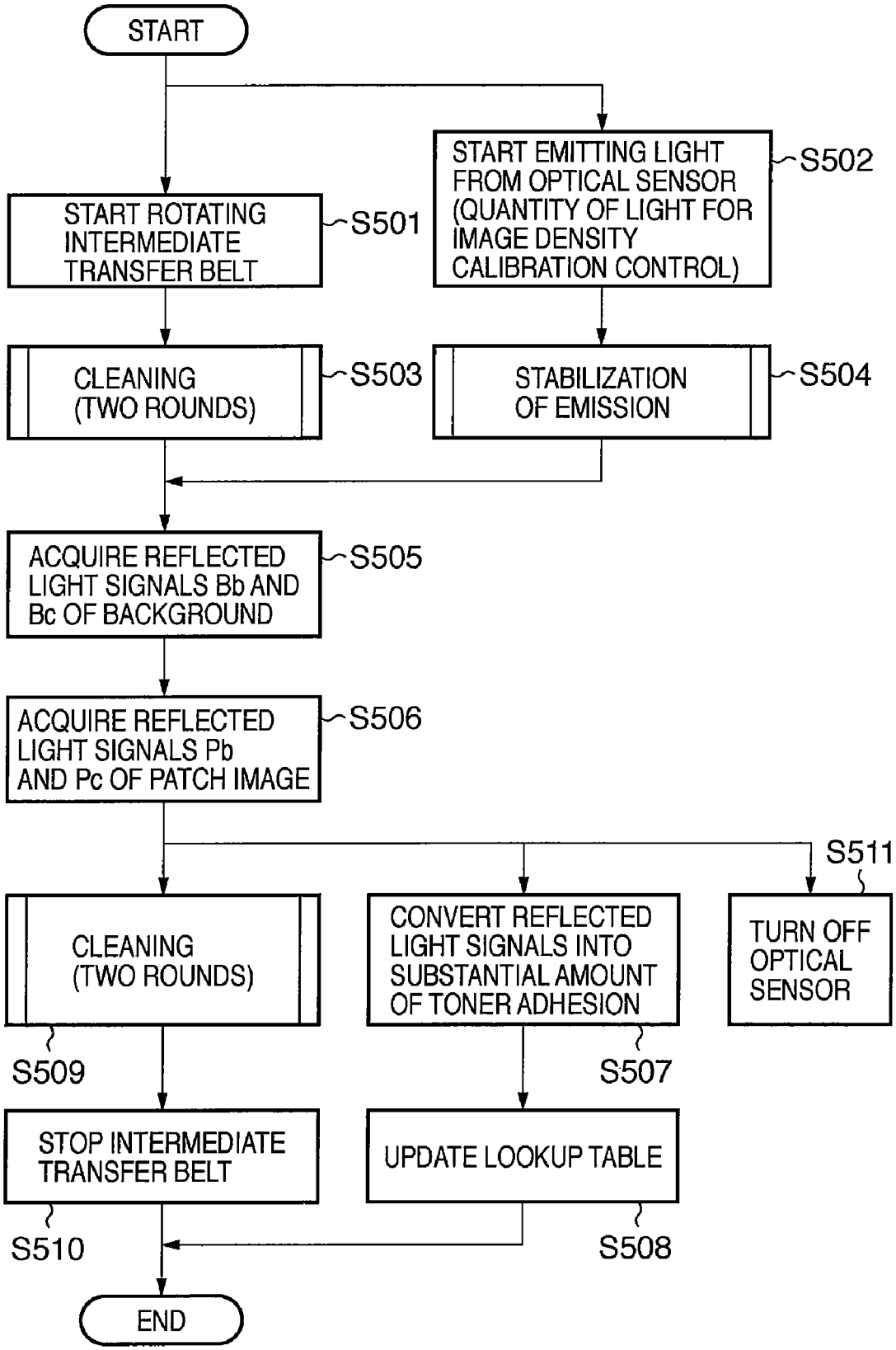
FIG. 5 is a flowchart showing an example of image density calibration control according to the first embodiment.

FIG. 5 is a flowchart showing an example of image density calibration control according to the first embodiment. In step S501, the density calibration control unit 112 starts rotating the intermediate transfer belt 31. In step S502 parallel to step S501, the density calibration control unit 112 causes the optical sensor 104 to emit light at a light quantity setting which is stored in the nonvolatile memory 109 and used to execute image density calibration control.

In step S503, the density calibration control unit 112 instructs the driving control unit 108 to make the intermediate transfer belt 31 rotate two rounds. The driving control unit 108 controls the driving motor of the intermediate transfer belt 31 to make the intermediate transfer belt 31 rotate two rounds. Then, the cleaner 33 removes toner adhered to the intermediate transfer belt 31. In step S504 parallel to step S503, the density calibration control unit 112 monitors output signals from the light receiving elements 302 and 303, and waits until emission of the optical sensor 104 stabilizes. After the density calibration control unit 112 confirms that the emission has stabilized, the process advances to step S505.

In step S505, the density calibration control unit 112 starts acquiring reflected light signals Bb and Bc from the light receiving elements 302 and 303 for light reflected by the intermediate transfer belt 31 itself (i.e., the background). The reflected light signal Bb corresponds to a background output from the light receiving element 302. The reflected light signal Bc corresponds to a background output from the light receiving element 303.

In step S506, the density calibration control unit 112 acquires reflected light signals Pb and Pc corresponding to the respective tones of low to high densities formed on the intermediate transfer belt 31. The reflected light signal Pb corresponds to a patch output from the light receiving element 302. The reflected light signal Pc corresponds to a patch output from the light receiving element 303. More specifically, the density calibration control unit 112 waits until the intermediate transfer belt 31 rotates one round more. After that, the density calibration control unit 112 controls each image forming station to form a patch image (FIG. 6) of each color. The reflected light signals Pb and Pc correspond to light beams reflected by the center of a patch image.

Figure 6:
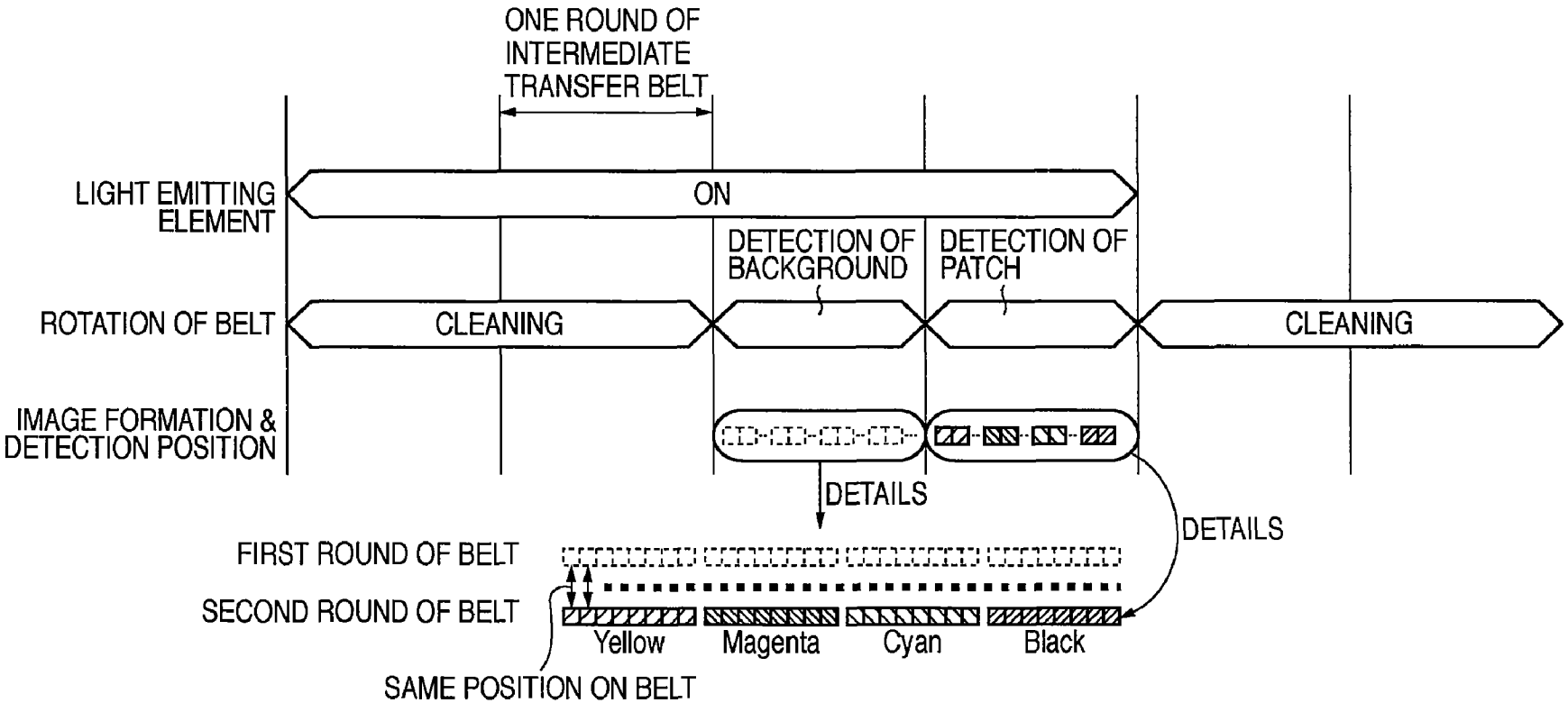
FIG. 6 is a timing chart showing an example of the emission timing, intermediate transfer belt rotation timing, and patch image formation timing.

FIG. 6 is a timing chart showing an example of the emission timing, intermediate transfer belt rotation timing, and patch image formation timing. Cleaning of the intermediate transfer belt is executed during the standby time until stabilization of the light emitting element. Then, a background output is detected, and a patch output is detected. Each image forming station forms patch images in a single color. However, patch images of each color have different densities (different image forming conditions).

In steps S505 and S506, the density calibration control unit 112 controls to acquire a background output and patch output at the same position on the intermediate transfer belt 31. This positional control is achieved by the above-described timing control using the circumference. More specifically, the density calibration control unit 112 acquires a patch output at a timing when a time corresponding to a circumference obtained by the circumference measurement unit 111 has elapsed after a timing when a background output at an arbitrary position was acquired. This can make a background output and patch output acquired at the same position correspond to each other. The timing need not be the time of a timepiece, and suffices to be the count value of a timer. In this manner, the density calibration control unit 112 and circumference measurement unit 111 function to specify a single position on the rotation member using information associated with the circumference of the rotation member.

Upon completion of acquiring all the reflected light signals Pb and Pc from the light receiving elements 302 and 303, the process advances to step S511. The density calibration control unit 112 turns off the light emitting element 301 of the optical sensor 104.

Figure 7:
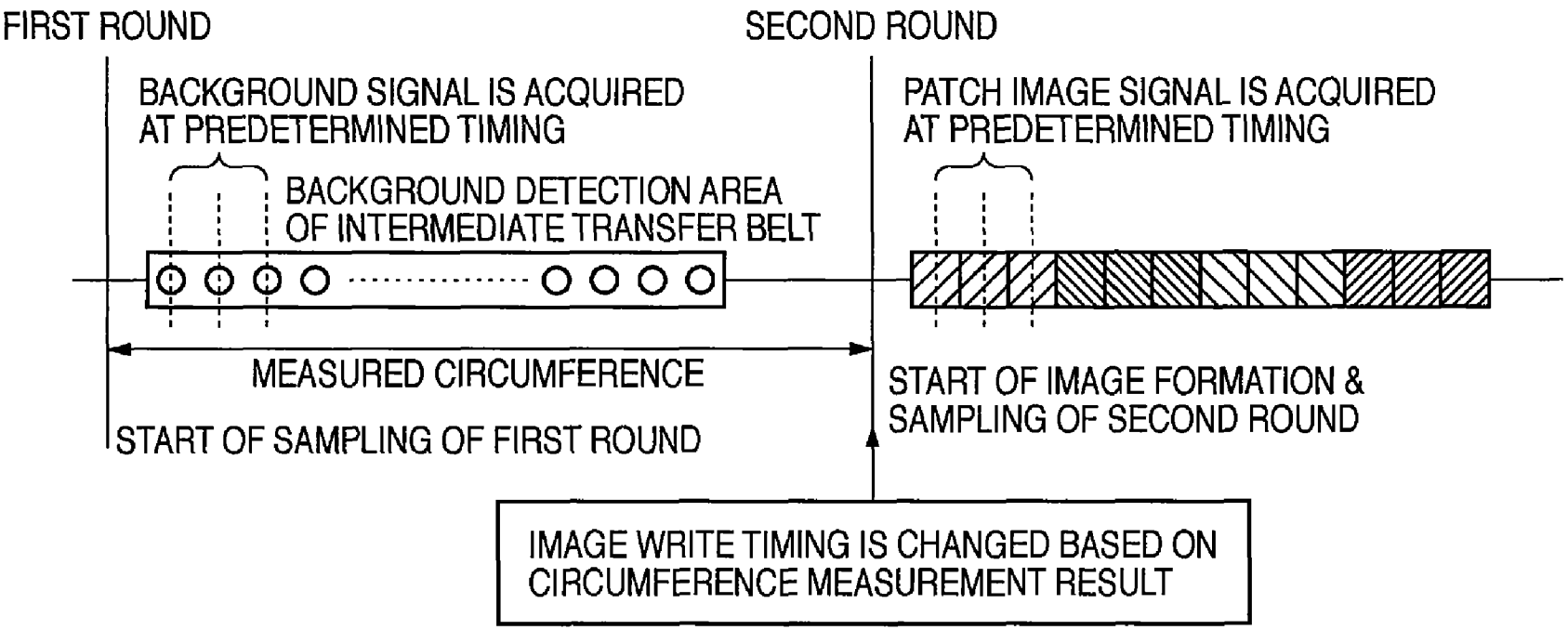
FIG. 7 is a timing chart for explaining sampling of the background density and patch image density.

The above-described steps S505 and S506 will be explained in detail with reference to FIG. 7. FIG. 7 is a timing chart for explaining sampling of the background density and patch image density. Image density calibration control according to the first embodiment adopts the following method to acquire signals representing light beams reflected by the background and a patch image at the same position on the intermediate transfer belt 31.

At the start of background sampling in the first round, the timer starts. By using the value (count value or time) of the started timer as a reference, the background signal of the intermediate transfer belt 31 is sampled at a predetermined timing stored in advance in the ROM 102.

The time during which the intermediate transfer belt 31 rotates one round is monitored based on information associated with an actual circumference measured in circumference measurement. More specifically, when the time during which the intermediate transfer belt 31 rotates one round has elapsed after the start of background sampling in the first round, patch image formation and patch sampling in the second round start. Whether the time during which the intermediate transfer belt 31 rotates one round has elapsed can be determined by monitoring the value of the timer which has started at the start of sampling. Sampling in the second round will be explained in more detail. For example, when a detected circumference measurement result is longer by 1.0 mm than a nominal value (ideal dimension value free from any manufacturing tolerance or environmental variations), a predetermined patch image write timing and sampling start timing are delayed by a time corresponding to 1.0 mm. This control can make the background position and patch position coincide with each other. Similar to sampling in the first round, sampling in the second round also uses the value (count value or time) of the started timer as a reference. A patch image signal is acquired at a predetermined timing stored in the ROM 102.

As a feature of the present invention, when performing this image density calibration control, information for obtaining the circumference of the intermediate transfer belt 31 that requires an accurate value but may vary is acquired at low cost within a short downtime. This will be explained in detail later.

Referring back to FIG. 5, in step S507 parallel to step S511, the density calibration control unit 112 calculates the substantial amount of toner adhesion based on an acquired patch output serving as the detection result of a patch image corresponding to each tone, and a background output corresponding to the patch image. The substantial amount of toner adhesion is almost the reciprocal of the amount of toner adhered onto the intermediate transfer belt. As the conversion method, a variety of methods are available.

For example, the substantial amount of toner adhesion can be calculated using Bb, Bc, Pb, and Pc:

$$\text{substantial amount of toner adhesion}=(Pb-\alpha*(Pc-Bc))/Bb \quad (1)$$

where $\alpha$ is the constant. The constant $\alpha$ may also be stored in the ROM 102, RAM 103, or nonvolatile memory 109, or calculated from data stored in them. $\alpha$ may change for each model, and is determined by an experiment or simulation.

As described above, a smaller value of the substantial amount of toner adhesion increases the amount of toner adhesion in practice. This is because the quantity of reflected light decreases at high toner density. Bb serving as the denominator of equation (1) means net specularly reflected light (obtained by subtracting a diffusely reflected component) received by the light receiving element 302 upon irradiating a patch image with light. By using a table (FIG. 8) stored in the ROM 102, the substantial amount of toner adhesion can be further converted into an amount of toner adhesion or an actual image density upon actually printing on paper.

Figure 8:
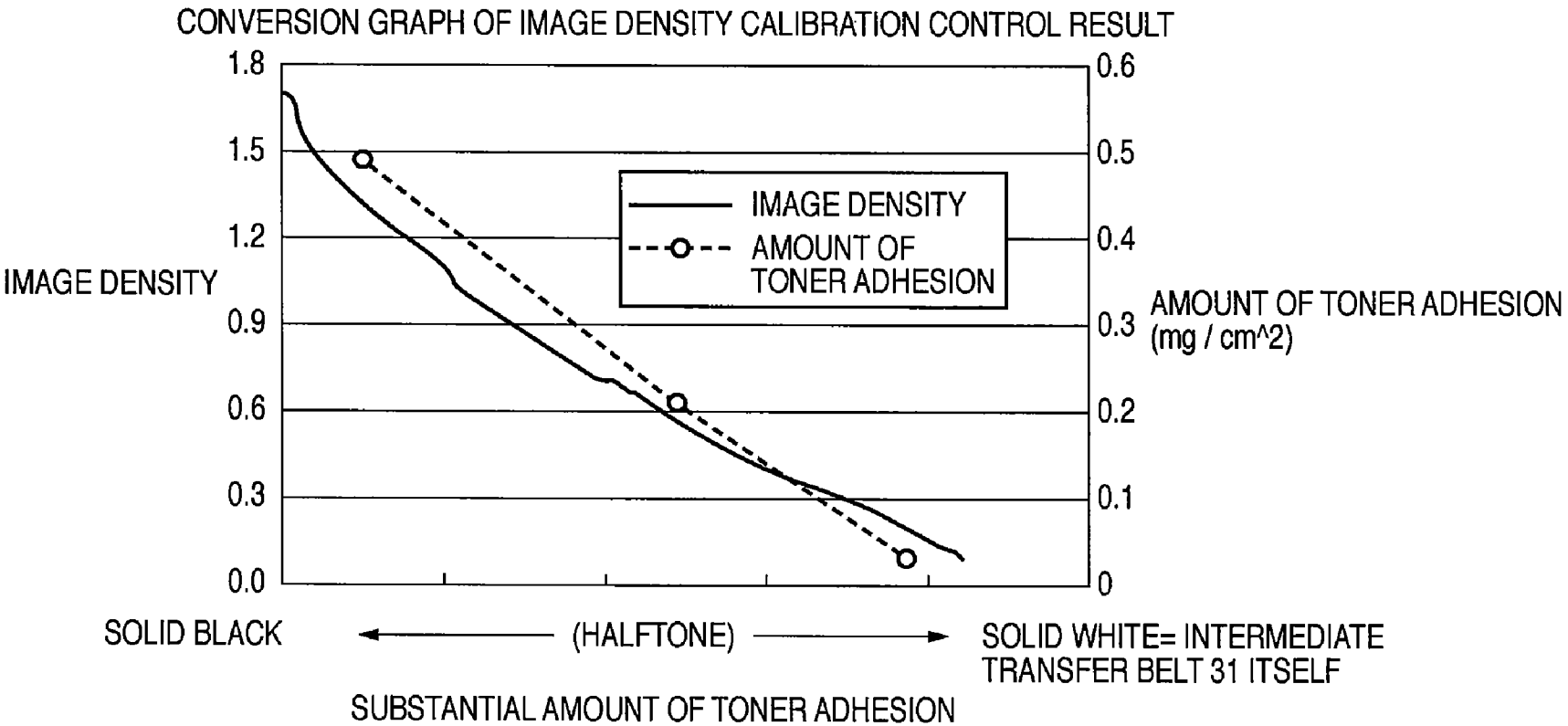
FIG. 8 is a graph showing an example of a table which holds the relationship between the substantial amount of toner adhesion, the image density, and the amount of toner adhesion.

FIG. 8 is a graph showing an example of a table which holds the relationship between the substantial amount of toner adhesion and the image density, and that between the substantial amount of toner adhesion and the amount of toner adhesion. Use of this table allows further converting a calculated substantial amount of toner adhesion into an amount of toner adhesion or an image density.

In step S508, the density calibration control unit 112 updates the lookup table serving as the dynamic characteristic of the apparatus so that the result of converting the detection result of each tone of each color into a substantial amount of toner adhesion, amount of toner adhesion, or image density corresponds to an original tone. By updating the lookup table, an image can be formed on a printing material at a set image density.

In this way, the density calibration control unit 112 is an example of a unit which controls the density of a formed image based on each background data and each patch detection result. Each background data is data of light reflected by the background of the rotation member throughout the circumference of the rotation member that starts from an arbitrary position on the rotation member. Each developer image data is data of light reflected by each developer image formed in another round at the same position as the position where each background data has been acquired.

In step S509 parallel to step S507, the density calibration control unit 112 instructs the driving control unit 108 to clean a patch image formed on the intermediate transfer belt 31. This cleaning is done in two rounds of the intermediate transfer belt 31. Upon completion of cleaning, in step S510, the density calibration control unit 112 instructs the driving control unit 108 to stop the rotation of the intermediate transfer belt 31.

[Details of Method of Measuring Information Associated with Circumference]

Figure 9A:
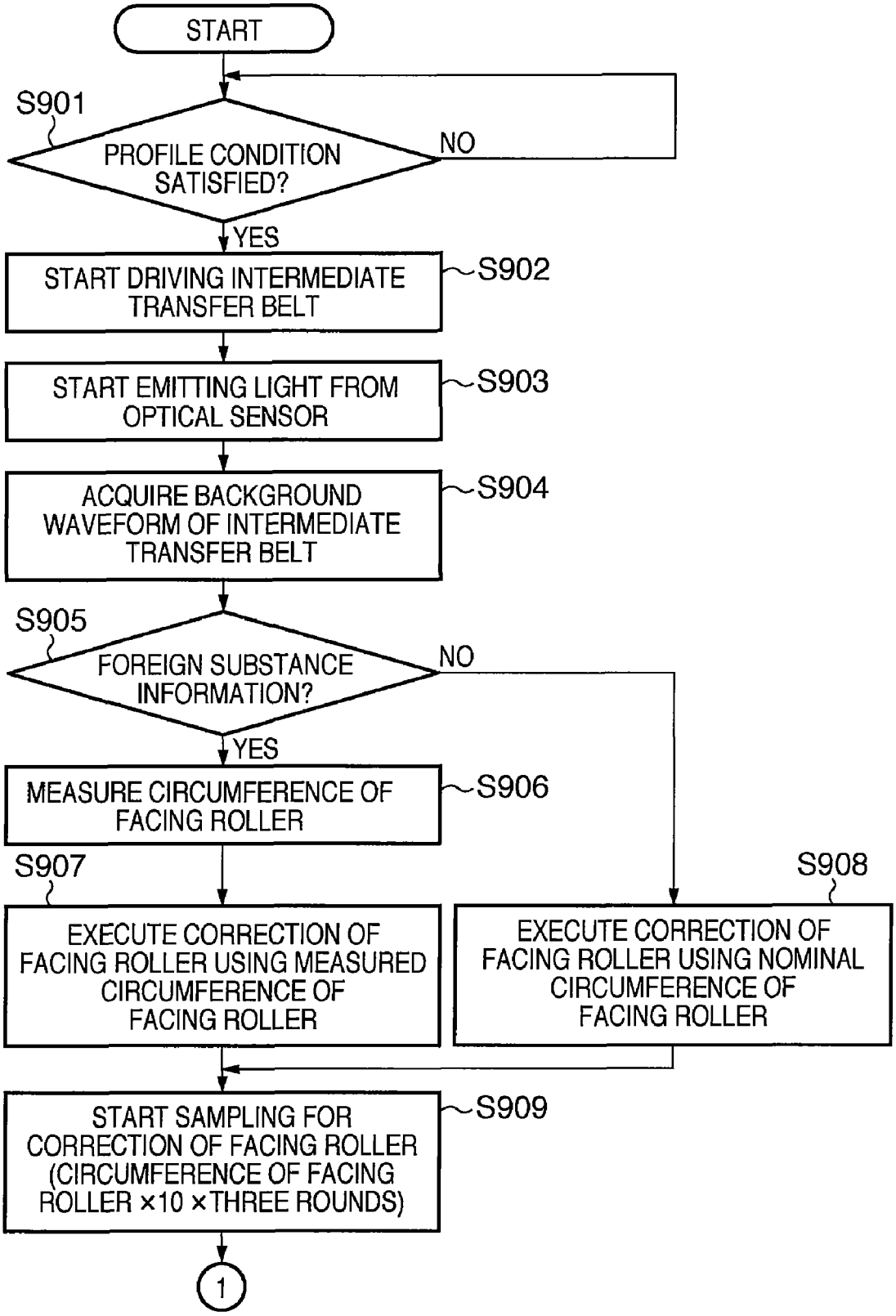
FIGS. 9A and 9B are flowcharts showing an intermediate transfer belt circumference measurement method according to the first embodiment.
Figure 9B:
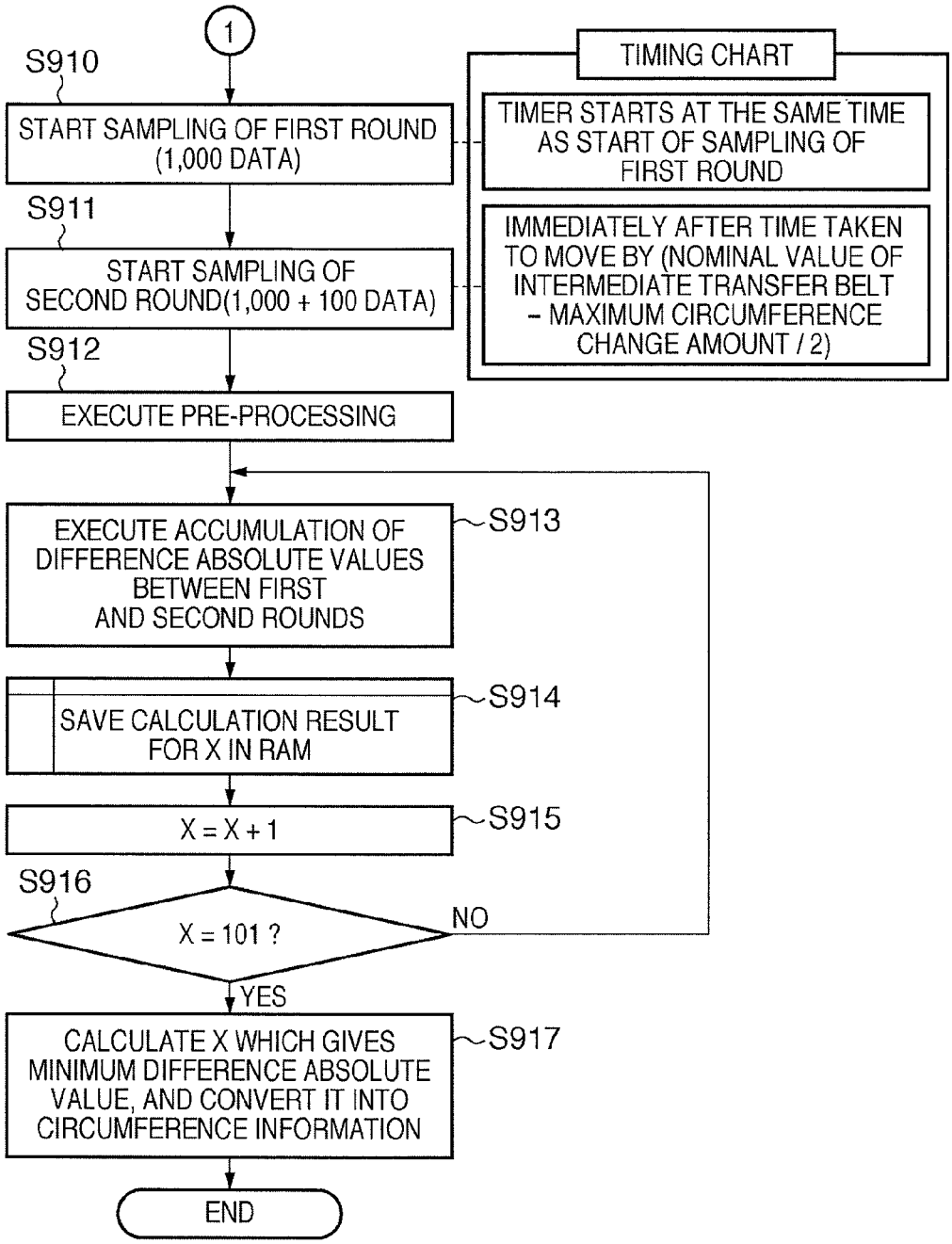

The circumference measurement method in the first embodiment will be explained in detail. In the first embodiment, the circumference of the intermediate transfer belt 31 is measured as an example of a target for measuring the dynamic characteristic of the apparatus. FIGS. 9A and 9B are a flowchart showing an intermediate transfer belt circumference measurement method according to the first embodiment. The CPU 101 executes the following processing by loading a control program stored in the ROM 102 into the RAM 103.

In step S901, the circumference measurement unit 111 of the CPU 101 determines whether to measure a circumference. The condition to determine whether to measure a circumference includes the following examples. This determination corresponds to determination of whether to perform image density calibration control.

- a case wherein the number of conveyed sheets after previous circumference measurement is equal to or larger than a predetermined number of sheets.
- a case wherein an environment parameter has varied by a predetermined value or more from the environment in previous circumference measurement.
- a case wherein the standing time after the final print job is equal to or longer than a predetermined time.
- a case wherein a process cartridge has been exchanged.

In step S902, the circumference measurement unit 111 instructs the driving control unit 108 to drive the intermediate transfer belt 31. Then, driving of the intermediate transfer belt 31 starts.

In step S903, the circumference measurement unit 111 causes the light emitting element 301 of the optical sensor 104 to emit the same quantity of light as that in image density calibration control. The background reflects light emitted from the light emitting element 301, and the light receiving element 302 receives the reflected light. The light receiving element 302 outputs a signal corresponding to the reflected light quantity.

In step S904, the circumference measurement unit 111 executes sampling of the background waveform of the intermediate transfer belt 31 for the output value of reflected light received by the light receiving element 302. More specifically, the circumference measurement unit 111 executes the sampling as follows. The light receiving element 302 receives and detects a light component reflected by the intermediate transfer belt 31. The RAM 103 stores a signal corresponding to the received light. Then, the circumference measurement unit 111 executes sampling. The sampling in this step is executed to determine whether there is a foreign substance generated from the driving roller 8 (to be referred to as a facing roller hereinafter) facing the optical sensor 104. The sampling area suffices to be at least "the nominal circumference of the facing roller+the maximum change amount of the diameter of the facing roller".

The sampling area represents the moving distance of a portion irradiated with light by the light emitting element 301 during sampling in the moving direction of the sampling target. In the image forming apparatus according to the first embodiment, the nominal circumference of the facing roller is 92.0 mm, and the maximum change amount is ±1.0 mm (±1.2%). Sampling is executed at an interval of 0.1 mm. The nominal circumference and maximum change amount of the facing roller can be set to appropriate values in accordance with the application purpose of the image forming apparatus and the like, and are not limited to these values.

In step S905, based on the acquisition result in step S904, the circumference measurement unit 111 determines whether a foreign substance is adhered to the facing roller immediately below the optical sensor 104. In accordance with the result of determining whether a foreign substance is adhered, the flowchart of FIG. 9A selectively uses methods for deciding the moving amount of the surface of the intermediate transfer belt 31 when the facing roller rotates once, which will be described in detail later. The respective methods will be discriminated by calling them the first and second decision methods.

The determination processing in step S904 will be explained in detail. In step S904, the average output value of sampling results from the light receiving element 302 is calculated. The circumference measurement unit 111 obtains the maximum and minimum ones of sampling values in step S904. If the difference between the average value of sampling results in S904 and either the obtained maximum or minimum value exceeds a predetermined threshold, the circumference measurement unit 111 determines that a foreign substance exists on the facing roller. If the circumference measurement unit 111 determines that a foreign substance exists, it measures in step S906 (to be described later) the moving amount by which the surface of the intermediate transfer belt 31 moves while the facing roller rotates once. The moving amount by which the surface of the intermediate transfer belt 31 moves while the facing roller rotates once will be simply referred to as ABSM (Amount of Belt Surface Movement corresponding to one rotation of facing roller). ABSM corresponds to the circumference of the facing roller.

If the difference between either the maximum or minimum value of the sampling value and the average value of sampling results in step S904 does not exceed the predetermined threshold, the circumference measurement unit 111 determines that no foreign substance exists on the facing roller. Then, the circumference measurement unit 111 executes processing in step S908. Correction of the facing roller means processing to cancel the influence of the facing roller on the detection result of the optical sensor. In the image forming apparatus according to the first embodiment, the foreign substance determination threshold is set to 0.3 V. However, the threshold suffices to be set to an appropriate value depending on the magnitude of a signal corresponding to a foreign substance when the foreign substance exists between the facing roller and the intermediate transfer belt 31.

In step S906, the circumference measurement unit 111 extracts a signal (foreign substance information) adversely affected by the foreign substance from signals of the background waveform of the intermediate transfer belt 31 that has been sampled in step S904. The circumference measurement unit 111 executes ABSM measurement based on the foreign substance information. In the first embodiment, to increase the detection precision, cycle measurement is executed while the intermediate transfer belt 31 rotates about two rounds. In the color image forming apparatus shown in FIG. 1, the facing roller rotates 17 times while the intermediate transfer belt 31 rotates about two rounds. In step S906, cycle measurement is done during 17 turns of the facing roller.

Figure 10:
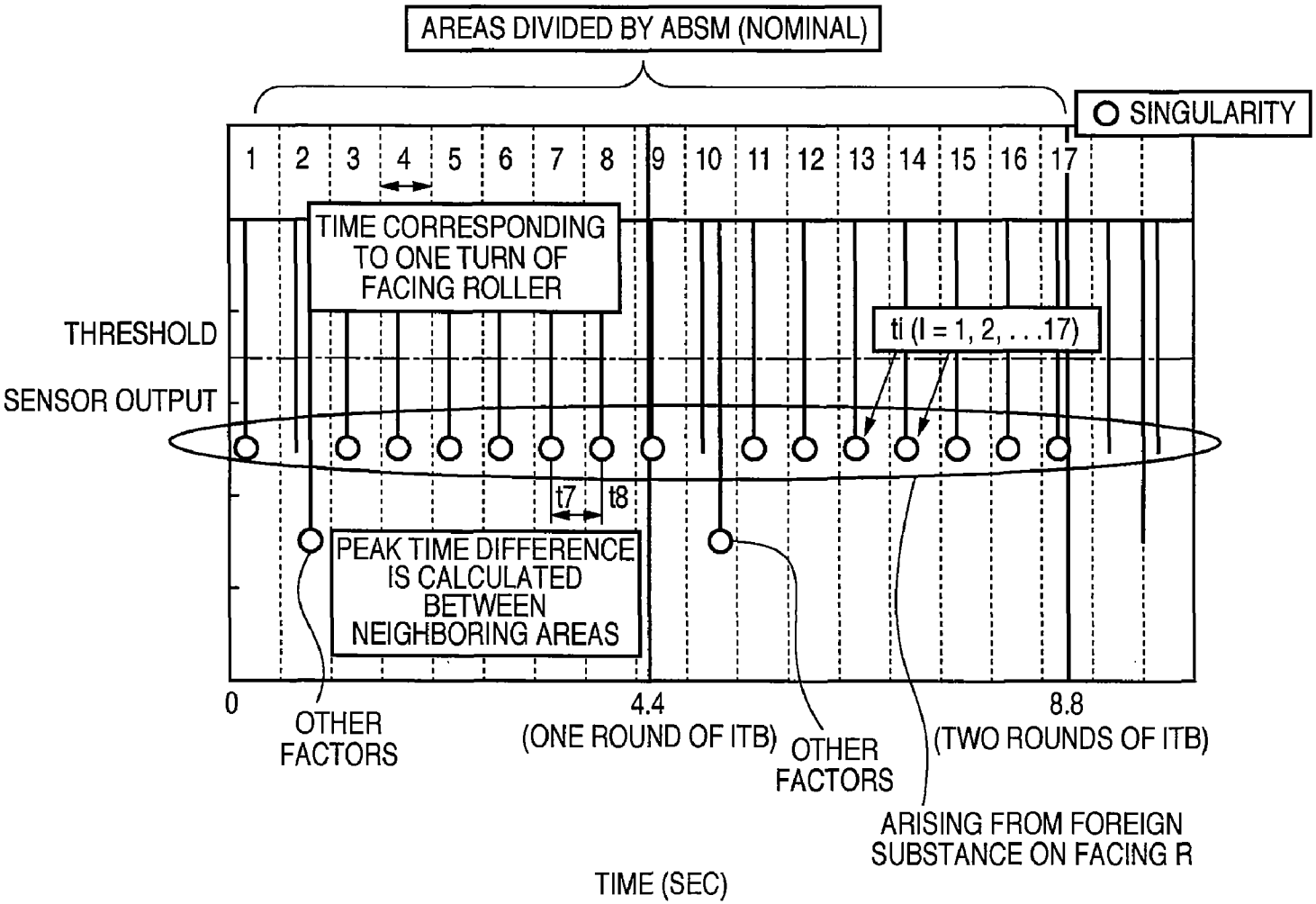
FIG. 10 is a view showing determination of a foreign substance adhered to a facing roller according to the first embodiment.

ABSM measurement will be explained with reference to FIG. 10. FIG. 10 is a view showing determination of a foreign substance adhered to the facing roller according to the first embodiment. In FIG. 10, the abscissa axis represents the time (timer value: ti) during which the facing roller rotates, and the ordinate axis represents an output from the optical sensor 104. Each singularity ○ shown in FIG. 10 represents a sampling point when the sensor output exceeds the foreign substance determination threshold.

As shown in FIG. 10, the RAM stores a timer value ti (i=area numbers 1, 2, . . . , 17) when the sensor output exceeds the foreign substance determination threshold for each nominal value of ABSM (Amount of Belt Surface Movement corresponding to one rotation of facing roller). "17" represents the number of turns of the facing roller while the intermediate transfer belt 31 rotates about two rounds. If a plurality of sensor outputs exceeding the foreign substance threshold is detected in one area, the RAM saves only a timer value obtained when the final sensor output is detected in the area.

Figure 11:
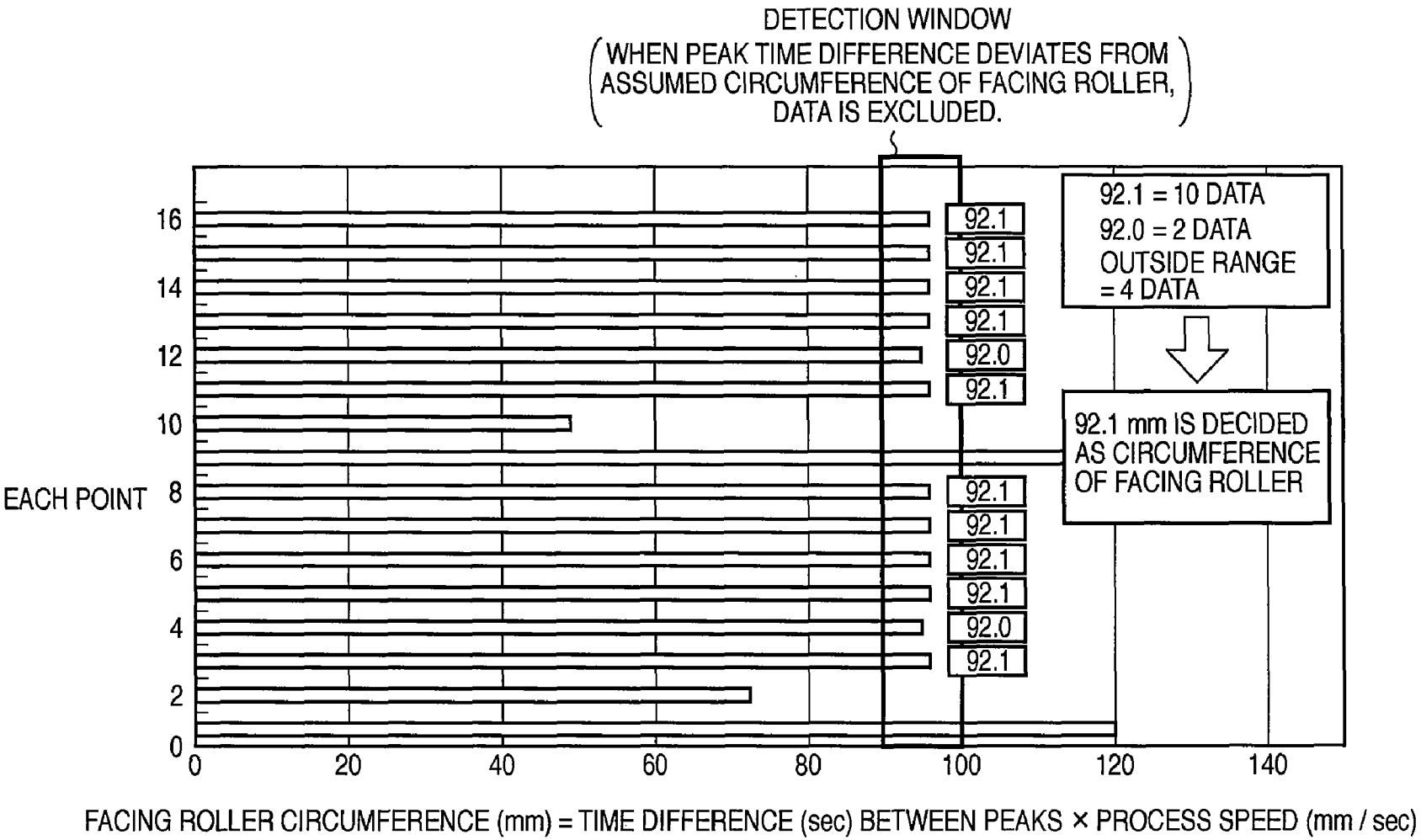
FIG. 11 is a view for explaining a facing roller circumference measurement method according to the first embodiment.

The difference between times when sensor outputs obtained in adjacent areas exceed the foreign substance determination threshold is calculated. At this time, the facing roller has rotated 17 times. Thus, time difference values between areas are calculated for a total of 16 data, as shown in FIG. 11. FIG. 11 is a view for explaining a facing roller circumference measurement method according to the first embodiment. In FIG. 11, the abscissa axis represents the facing roller circumference (i.e., ABSM), and the ordinate axis represents the point of a difference value obtained between adjacent areas in FIG. 10. For example, point "6" represents the difference between timer values t7 and t8 shown in FIG. 10.

The facing roller circumference (i.e., ABSM) is decided by a majority method from facing roller circumferences calculated by multiplying time difference values by the process speed. Since ABSM is decided by the majority method, the circumference of the facing roller can be calculated excluding improper sampling data. If the number of decimal places of sampling data is increased, all data exceeding the foreign substance determination threshold may change. In this case, data falling within a given range may also be averaged. In the first embodiment, the facing roller rotates 17 times (a plurality of number of times) for ABSM measurement in order to ensure high ABSM measurement precision. However, the facing roller need not always rotate 17 times, and suffices to rotate several times.

When the difference timer value deviates from an assumed ABSM value, it is counted as "outside the range". In the image forming apparatus of the first embodiment, the change amount of the diameter of the facing roller is ±1 mm. When ABSM calculated by multiplying difference data between timer values by the process speed falls outside the range of 91 mm to 93 mm, it is counted as "outside the range".

In the image forming apparatus of the first embodiment, the nominal circumference value of the intermediate transfer belt 31 is 791.7 mm, and the process speed is 180 mm/sec. Hence, ABSM measurement in step S906 takes about 9 sec. If the necessity to update ABSM is low, it is preferably omitted. This can shorten the downtime of the image forming apparatus and improve user convenience.

Referring back to FIG. 9A, in step S907, the circumference measurement unit 111 cancels the influence of the facing roller using ABSM measured in step S906. If the circumference measurement unit 111 determines in step S905 that no foreign substance is adhered to the facing roller, it cancels in step S908 the influence of the facing roller using the nominal circumference value of the facing roller that is stored in the memory in advance. The method of deciding the circumference of the facing roller in step S906 described above will be called the first decision method. A method of deciding the circumference of the facing roller by reading it out from the memory will be called the second decision method. In this way, these two methods can be discriminated.

Figure 12:
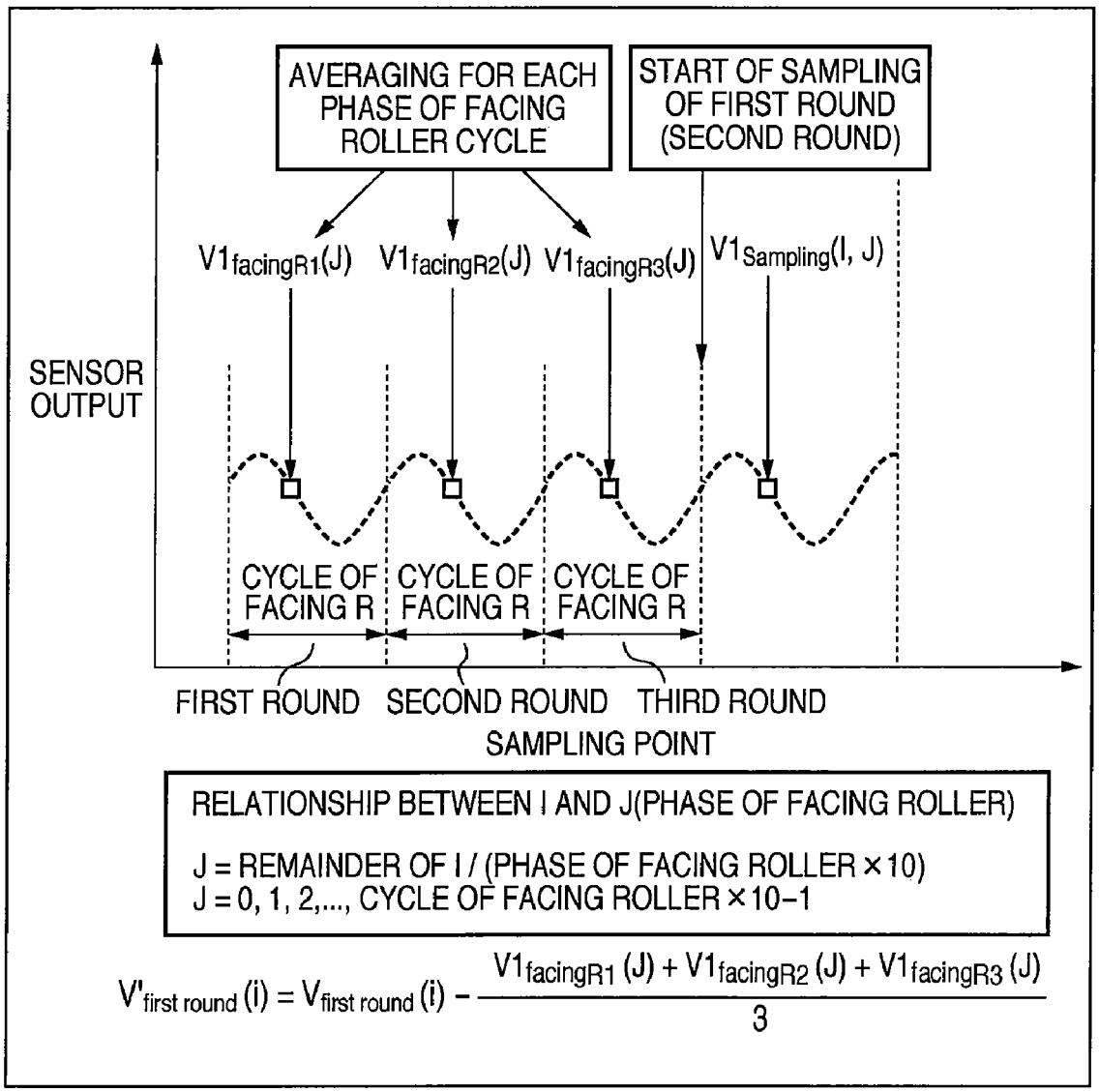
FIG. 12 is a view for explaining processing to cancel the influence of the facing roller according to the first embodiment.

A calculation method of canceling variations of the circumference of the facing roller will be explained with reference to FIG. 12. FIG. 12 is a view for explaining processing to cancel the influence of the facing roller according to the first embodiment. As shown in FIG. 12, in step S909, the circumference measurement unit 111 performs sampling for three rounds of the facing roller at an arbitrary timing in order to extract the foreign substance component of the facing roller. The cycle obtained in the above-described step S907 is used as ABSM. Sampling is executed at an interval of 0.1 mm. Averaging for three rounds is done in each phase.

After the end of sampling facing roller correction data in step S909, in step S910, the circumference measurement unit 111 executes sampling of the first round of the intermediate transfer belt 31 for the output value of reflected light received by the light receiving element 302. After the end of sampling facing roller correction data, sampling of the first round of the intermediate transfer belt 31 is executed. In this case, for example, the first sampling point coincides with the phase of the first sampling point of the facing roller. The circumference of the facing roller has been obtained in step S907. Thus, managing the moving amount of the intermediate transfer belt 31 can specify a phase of the facing roller to which newly sampled data corresponds. The moving speed of the intermediate transfer belt 31 is constant. Hence, the moving amount of the intermediate transfer belt 31 can be managed by the elapsed time, sampling count, and the like. By continuing sampling of the first round of the intermediate transfer belt 31, calculations based on the following equations (2) and (3) can be done.

Sampling in step S910 is used to measure the circumference of the intermediate transfer belt 31. The RAM 103 stores a reflected light output value at each sampling point as the waveform profile (first waveform data) of the first round. That is, the circumference measurement unit 111 is an example of an acquisition unit which acquires a pattern as a waveform profile. The circumference measurement unit 111 acquires waveform profiles a plurality of number of times, which will be described later. Acquisitions at respective timings can also be referred to as the first acquisition, second acquisition, and the like. The waveform profile of the first round is an arbitrary profile of reflected light in an arbitrary section on the rotation member because sampling starts at an arbitrary position. The following description will use the term "waveform profile". The waveform profile means the characteristic or feature of measured waveform data. The circumference measurement unit 111 is an example of the first acquisition unit.

By this sampling, 1,000 data are acquired in 0.1-mm cycles. The 1,000 data correspond to 100 mm. Considering that the nominal circumference is 800 nm, the length of 100 mm is about ⅛ of the entire length. The measurement start timing in the first round is arbitrary. That is, no intermediate transfer belt need rotate until a specific mark reaches the detection point, unlike the conventional method. This leads to a short downtime. This sampling need not acquire data of one round of the intermediate transfer belt 31. It suffices to acquire data of about ⅛ of the entire length, reducing the memory consumption for storing acquired data.

Figure 13:
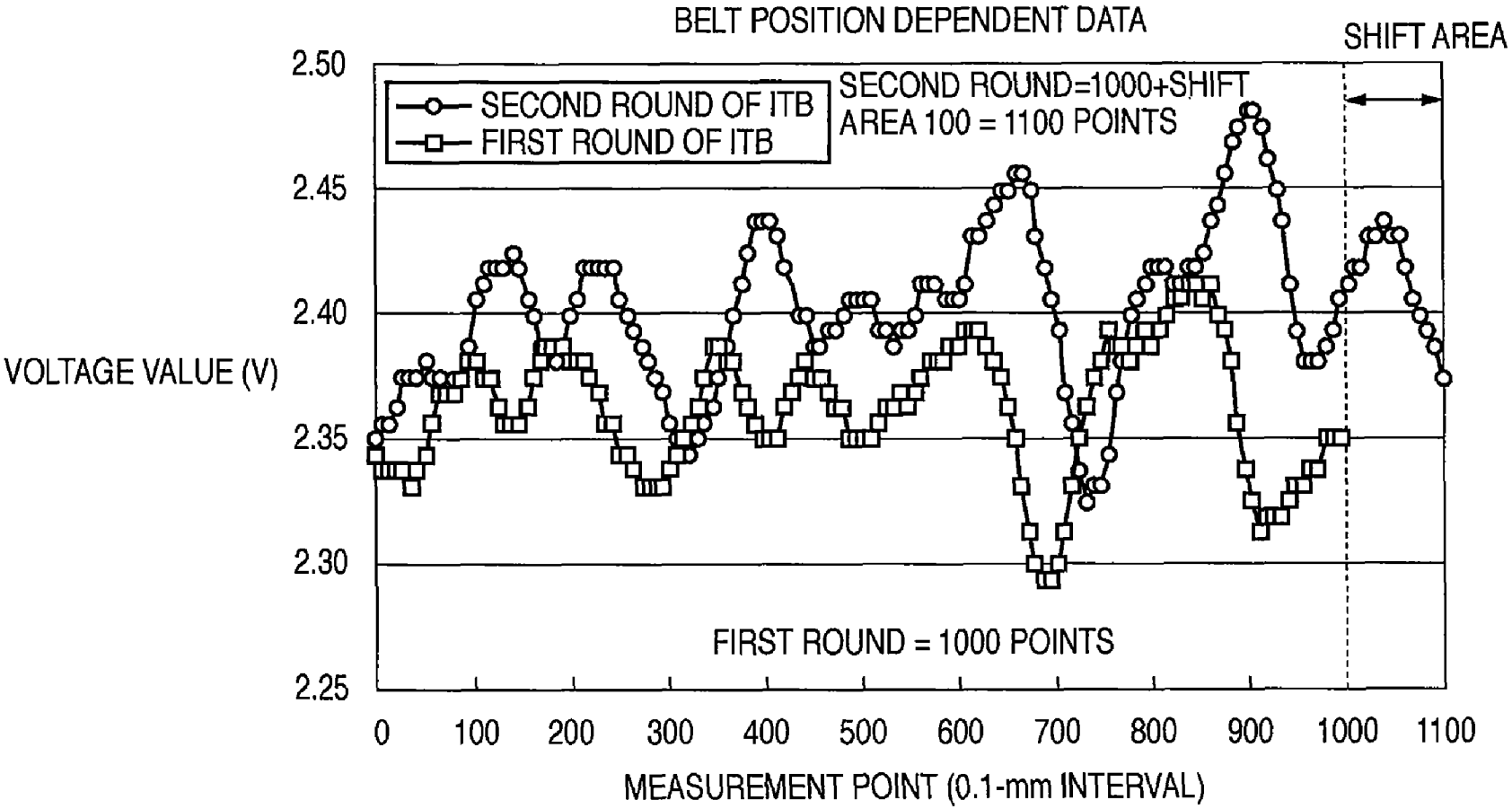
FIG. 13 is a graph showing an example of the relationship between each sampling point and a reflected light output value.

FIG. 13 is a graph showing an example of the relationship between each sampling point and a reflected light output value. FIG. 13 shows the waveform profiles of the first and second rounds. The waveform profile of the second round contains a larger number of sample values than those in the waveform profile of the first round because a shift area exists. The shift area is a margin for obtaining a shift amount from the nominal circumference. The shift area is decided in consideration of the maximum circumference change amount which is the maximum value of the circumference change amount (expansion and contraction characteristic) of the intermediate transfer belt 31.

Based on the waveform data detection timing of the first round (for example, at the same time as the start of sampling), the circumference measurement unit 111 starts a timer for deciding the sampling start timing of the second round. Waveform data of the second round is sampled so that the section of the image-formed surface of one of the waveform data of the first and second rounds falls within the section of the image-formed surface corresponding to the other waveform data. In other words, when the circumference measurement unit 111 acquires two waveform data from the RAM 103, the section of an image-formed surface corresponding to one waveform data falls within that of an image-formed surface corresponding to the other waveform data. From this, waveform data of the second round is sampled at a timing which is adjusted by a predetermined time from a predetermined reference time necessary for the intermediate transfer belt 31 to rotate only one round by using the waveform data detection timing of the first round as a reference. The RAM 103 stores the sampled waveform data. In the case of FIGS. 9A and 9B, a value obtained by subtracting half the maximum circumference change amount from one nominal circumference is set in the timer. The value subtracted from one nominal circumference when setting the timer is not limited to half the maximum circumference change amount. A predetermined value may also be set as long as no measurement error frequently occurs. When the timing set in the timer has come, the process advances to step S911.

As shown in FIG. 13, waveform data acquired from the RAM 103 corresponds to the section of part of the intermediate transfer belt 31 serving as a rotation member. The amount of data stored in the RAM 103 in sampling can be reduced, suppressing memory utilization.

In step S911, the circumference measurement unit 111 executes sampling of the second round for the output value of reflected light received by the light receiving element 302. The number of sampling points in the second round is larger than that of sampling points in the first round, and corresponds to a long detection time. Considering a shift amount from the nominal circumference, one waveform data corresponds to a longer sampling time (detection time) than the other waveform data. When executing sampling of the second round in step S911, the correspondence between each sampling period and a phase of the facing roller sampled in step S909 has been specified. As described above, the correspondence between newly sampled data and a phase of the facing roller can be specified based on the facing roller circumference obtained in step S907 and the moving amount of the intermediate transfer belt 31.

Figure 14:
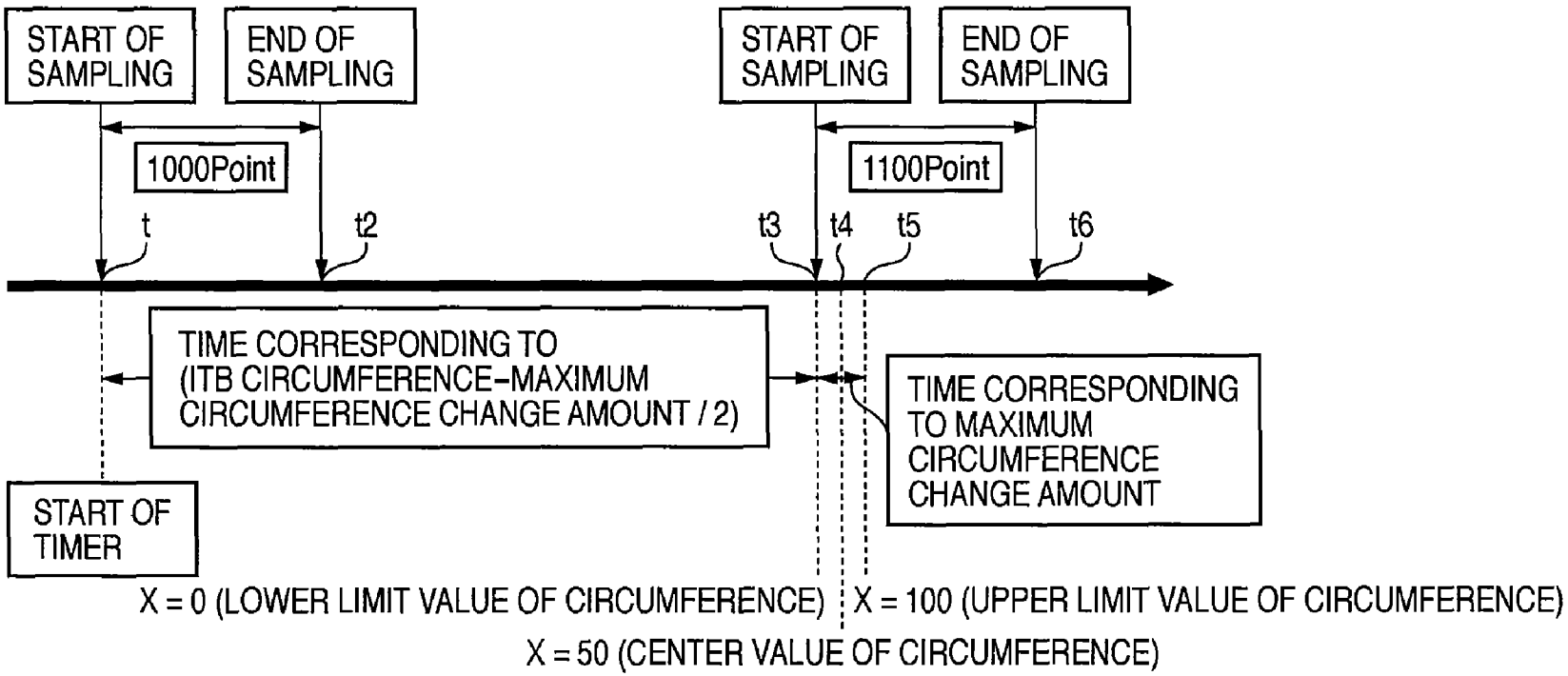
FIG. 14 is a timing chart for explaining timings from the sampling start timing t1 of the first round to the sampling end timing t6 of the second round.

FIG. 14 is a timing chart for explaining timings from the sampling start timing t1 of the first round to the sampling end timing t6 of the second round. t1 represents the sampling start timing (first timing) of the first round. t2 represents the sampling end timing of the first round, and t3 represents the sampling start timing (second timing) of the second round. t4 represents a timing corresponding to the nominal circumference from t1 serving as the start point. t5 represents a timing when the expansion amount of the circumference maximizes.

The interval between t1 and t2 represents the sampling period (first period) of the first round. The interval between t3 and t6 represents the sampling period (second period) of the second round.

The interval between t1 and t3 corresponds to the shortest time necessary for the intermediate transfer belt to rotate one round when the circumference of the intermediate transfer belt 31 varies to be the shortest. That is, the interval between t1 and t3 is the time calculated by dividing, by the process speed, a length obtained by subtracting half the maximum circumference change amount from the nominal circumference of the intermediate transfer belt. This aims at making the sampling start point of the first round fall within the section where the waveform profile of the second round has been acquired. If sampling is executed slightly excessively, the interval between t1 and t3 may also be further shortened.

The interval between t1 and t4 is the time obtained by dividing the nominal circumference of the intermediate transfer belt 31 by the process speed. The interval between t1 and t4 is a reference time necessary for the intermediate transfer belt 31 having the nominal circumference to rotate one round.

The sampling interval of the second round is 0.1 mm, similar to the first round. However, the number of sampling points in the second round is larger by the shift amount than that of sampling points in the first round. When the number of sampling points in the first round is 1,000 and the shift amount is 100 points, the number of sampling points in the second round is 1,100. In this example, the maximum circumference change amount is 10 mm. The RAM 103 also stores the waveform profile (second waveform data) of the second round. FIG. 13 shows the relationship between each sampling point and a reflected light output value.

In the flowcharts of FIGS. 9A and 9B, all sampled data are handled as waveform data, but the data are not limited to them. It suffices to acquire data for pattern matching calculation (to be described later). For example, extra sampling may also be done at the start and/or end timing to acquire two waveform data necessary for pattern matching calculation from the memory. As a preferable example, a case wherein only data necessary for pattern matching calculation are sampled will be exemplified.

After the end of sampling in the first and second rounds, the circumference measurement unit 111 executes pre-processing in step S912 in order to accumulate difference absolute values between the first round and the second round in step S913. More specifically, the circumference measurement unit 111 initializes a variable X representing the shift amount to 0. As will be described later, the circumference measurement unit 111 compares the waveform profile of the first round, and a plurality of waveform profiles (third waveform data) which are shifted by different shift amounts in the waveform profile of the second round and are equal in length to the waveform profile of the first round. The third waveform data are reflected light comparison profiles in a plurality of sections that are shifted by different shift amounts from a reference position based on one nominal circumference starting from the start position of a section where the waveform profile of the first round has been acquired.

In the pre-processing of step S912, the circumference measurement unit 111 subtracts a target phase component from the measurement result of sampling of the first rounds among the sampling results in steps S910 and S911. The circumference measurement unit 111 can reliably cancel the influence of an adhered foreign substance and that of variations of the facing roller circumference (ABSM). Sampling data after canceling the influence of the facing roller is given by $$V'_{first\ round}(i) = V_{firstr\ ound}(i) - \frac{V1_{facing\ R1}(J) + V1_{facing\ R2}(J) + V1_{facing\ R3}(J)}{3} \tag{2}$$

$$V'_{second\ round}(i) = V_{second\ round}(i) - \frac{V1_{facing\ R1}(J) + V1_{facing\ R2}(J) + V1_{facing\ R3}(J)}{3}$$

where $V'_{first\ round}(i)$ is the output value of reflected light received by the optical sensor 104 after canceling the influence of the facing roller at point i, $V_{first\ round}(i)$ is the raw output value of reflected light received by the optical sensor 104 at point i in the first round, and $V1_{facing\ R1}(J)$, $V1_{facing\ R2}(J)$, and $V1_{facing\ R3}(J)$ are the output values (corresponding to the first round, second round, and third round of the facing roller in order from the left) of reflected light received by the optical sensor 104 in ABSM correction when the phase of the facing roller is J.

In solving equation (2), the relationship between the sampling point i and the phase J of the facing roller is given by $$J = \text{remainder of } \frac{i}{Ld \times 10} \quad (J = 0, 1, 2, \ldots, Ld \times 10 - 1) \tag{3}$$

where Ld is ABSM (mm). For example, for i=100 and Ld=92 mm, J=100/(92×10)=100. For i=1,000 and Ld=92 mm, J=1000/(92×10)=80. According to equation (3), $V'_{second\ round}(i)$ can be calculated as the output value of reflected light received by the optical sensor 104 after canceling the influence of the facing roller.

In step S913, the circumference measurement unit 111 accumulates difference absolute values between the waveform profile of the first round and that (third waveform data) of the second round, in order to perform pattern matching between the two waveform data. For example, the accumulation is executed by $$I(X) = \sum_{i=1}^{1000} |V'_{first\ round}(i) - V'_{second\ round}(i + X)| \tag{4}$$

where I(X) is an accumulated value for the shift amount X, $V_{first\ round}(i)$ is a reflected light output value at the point i in the first round, and $V_{second\ round}(i+X)$ is a reflected light output value at the point i+X in the second round. Note that X=0, 1, 2, . . . , 100.

In step S914, the circumference measurement unit 111 stores the accumulated value I(X) in the RAM 103. In step S915, the circumference measurement unit 111 increments the X value by one. In step S916, the circumference measurement unit 111 determines whether the X value has exceeded the maximum shift amount. If no X value has exceeded the maximum shift amount, the process returns to step S913. If the X value has exceeded the maximum shift amount, the process advances to step S917. In this fashion, the circumference measurement unit 111 calculates accumulated values I(X) for all X from X=0 to X=100. In step S917, the circumference measurement unit 111 decides the minimum value among the calculated accumulated values I(X). When $V_{first\ round}(i)$ as one of two waveform data is used as reference waveform data, waveform data which matches $V_{first\ round}(i)$ can be extracted by the processing of determining the minimum accumulated value. Similarly in step S917, X corresponding to the minimum accumulated value I is extracted. The specified X represents a shift (expansion or contraction) from a predetermined nominal circumference serving as a reference. Thus, X is information (interval information) corresponding to the interval between $V_{first\ round}(i)$ serving as reference waveform data, and waveform data corresponding to X which gives a minimum accumulated value I. The X value becomes larger as the interval between reference waveform data and waveform data corresponding to X which gives a minimum accumulated value I becomes larger, and vice versa.

Figure 15:
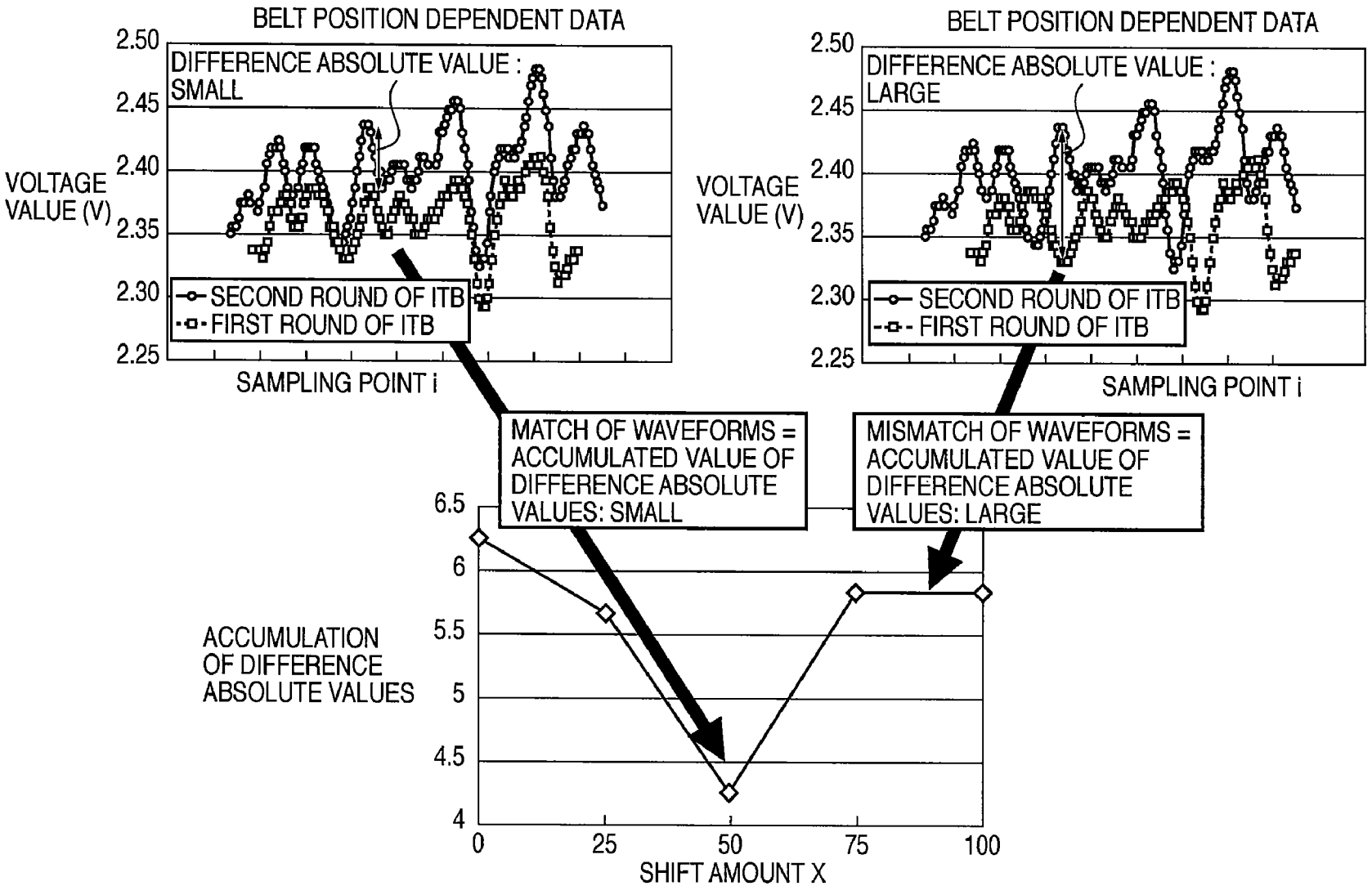
FIG. 15 is a graph showing the relationship between the waveform profiles of the first and second rounds and accumulated values according to the first embodiment.

FIG. 15 is a graph showing the relationship between the waveform profiles of the first and second rounds and accumulated values according to the first embodiment. FIG. 15 shows that the accumulated value minimizes when the correlation between two waveform profiles maximizes. This is based on the fact that reflected light output values detected at the same position are almost equal to each other. In contrast, reflected light output values detected at different positions have a low correlation and different waveform profiles. Thus, the accumulated value becomes relatively large. From this, the circumference measurement unit 111 has a function of extracting a comparison profile closest to an arbitrary profile from a plurality of comparison profiles. In this manner, a portion where the correlation between the waveforms of the first and second rounds is high is specified by equation (4), calculating information associated with the circumference of the intermediate transfer belt 31. This is a feature of the present invention.

In step S917, the circumference measurement unit 111 calculates an actual circumference which is information for grasping the circumference of the intermediate transfer belt and information (interval information) corresponding to the interval between waveform data. The circumference measurement unit 111 stores the calculated actual circumference in the RAM 103 or nonvolatile memory 109. The RAM 103 or nonvolatile memory 109 is an example of a storage unit which stores information representing a measured actual circumference. For example, the actual circumference can be calculated by equation (5) using an X value which gives a minimum accumulated value. Equation (5) gives information associated with the actual circumference as the dynamic characteristic of the intermediate transfer belt 31 serving as a rotation member from the nominal circumference and a shift amount obtained by comparing extracted waveform data and reference waveform data:

$$\text{actual circumference}=(X_{profile\ result}-X_{ITB\ ideal})*0.1+\text{nominal circumference} \quad (5)$$

where $X_{profile\ result}$ is X which gives a minimum accumulated value obtained in step S913, $X_{ITB}$ ideal is X (in this case, X=50) when the ITB circumference has a nominal value, and the nominal circumference is an ideal dimension value (792.1 mm for the intermediate transfer belt 31 of the first embodiment) when the ITB circumference is free from any manufacturing tolerance or environmental variations. The term "$(X_{profile\ result}-X_{ITB\ ideal})*0.1$" in equation (5) represents a shift (unit: mm) from an ideal dimension value when the measured circumference of the intermediate transfer belt 31 is free from any manufacturing tolerance or environmental variations. "*0.1" corresponds to sampling at an interval of 0.1 mm. When sampling is executed at an interval of 0.2 mm, it suffices to multiply 0.2.

When storing obtained information for grasping an actual circumference, the information may also be converted into time or length. In short, as described with reference to FIG. 7, information can be used to monitor the lapse of time during which the intermediate transfer belt 31 rotates one round accurately. The circumference measurement unit 111 also functions as a unit which calculates the actual circumference of a rotation member from a shift amount corresponding to an extracted comparison profile and the nominal circumference.

The density calibration control unit 112 of the CPU 101 executes the above-described image density calibration control using the value calculated by equation (5) serving as information associated with the actual circumference of the intermediate transfer belt 31 that has been finalized in step S917. As the information associated with the actual circumference, an expansion and contraction amount may also be obtained from a value calculated by subtracting 50 from X which gives a minimum accumulated value, and the time during which an arbitrary position rotates one round may also be calculated based on the obtained expansion and contraction amount. More specifically, the time (negative value for a negative expansion and contraction amount) corresponding to the obtained expansion and contraction amount is added to the time taken for the intermediate transfer belt 31 having the nominal circumference to rotate one round. As a result, image density calibration control can be executed accurately.

After executing image density calibration control, the CPU 101 returns to step S901 again. If the circumference measurement condition is satisfied, the CPU 101 executes the flowcharts shown in FIGS. 9A and 9B.

<Modification>

A modification to the first embodiment will be explained. In the first embodiment, waveform data based on sampling results in the first round of a rotation member are 1,000 data, and those based on sampling results in the second round are 1,100 data. In other words, the detection time of one waveform data acquired based on sampling in the first round is longer than that of the other waveform data acquired based on sampling in the second round. However, the waveform data are not limited to them. For example, the relationship between waveform data may also be reversed from that in the first embodiment. That is, the detection time of one waveform data acquired based on sampling in the second round may also be longer than that of the other waveform data acquired based on sampling in the first round.

In this case, calculation of information associated with the actual circumference of a rotation member will be explained mainly for a difference from the first embodiment with reference to FIGS. 9A and 9B for the intermediate transfer belt 31 serving as a typical example of a rotation member.

Processes corresponding to steps S901 to S909 are executed.

Then, in a process corresponding to step S910, the circumference measurement unit 111 executes sampling of the first round from an arbitrary position for the output value of reflected light received by the light receiving element 302. At the same time as the start of sampling of the first round, the circumference measurement unit 111 starts a timer for determining the sampling start timing of the second round.

At this time, the number of sampling points in the first round is 1,100 in correspondence with a shift amount of 100 points, unlike the first embodiment. The modification is different from the first embodiment in how to adjust a predetermined time from a predetermined reference time necessary for the intermediate transfer belt 31 to rotate one round by using the waveform data detection timing of the first round as a reference. More specifically, a value obtained by adding half the maximum circumference change amount to the nominal circumference is set in the timer.

However, similarly to the first embodiment, waveform data of the second round is sampled so that the section of the image-formed surface of one of the waveform data of the first and second rounds falls within the section of the image-formed surface corresponding to the other waveform data. Also similarly to the first embodiment, when the circumference measurement unit 111 acquires two waveform data from the RAM 103, a section of the image-formed surface that corresponds to one waveform data falls within a section of the image-formed surface that corresponds to the other waveform data.

Referring back to the flowchart, if the timer has reached the set value, sampling of the waveform profile of the second round starts in a process corresponding to step S911. At this time, the number of sampling points in the second round is 1,000 in the modification, unlike 1,100 in the first embodiment.

After executing a process corresponding to step S912 similarly to the first embodiment, processes corresponding to steps S913 to S915 continue until YES is determined in a process corresponding to step S916.

At this time, difference absolute values between waveform data (corresponding to the third waveform data) extracted from the waveform profile of the first round and the waveform profile of the second round are accumulated:

$$I(X)=\sum_{i=1}^{1000}|V_{second\ round}(i)-V_{first\ round}(i+X)| \quad (6)$$

Similar to the first embodiment, X=0, 1, 2, . . . , 100.

In a process corresponding to step S917, the circumference measurement unit 111 determines a minimum value among a plurality of calculated accumulated values I (X). The actual circumference can be calculated using an X value which gives a minimum accumulated value:

$$\text{actual circumference}=((100-X_{profile\ result})-X_{ITB\ ideal})*0.1+\text{nominal circumference} \quad (7)$$

In a process corresponding to step S917, the density calibration control unit 112 of the CPU 101 executes image density calibration control based on information associated with the actual circumference that has been calculated by equation (7).

As described above, even when waveform data corresponding to a long detection time is acquired in sampling of the first round, like the modification, the same effects as those of the first embodiment can be obtained.

The first embodiment and its modification reveal the following fact. More specifically, two acquired waveform data are defined as the first and second waveform data. One of the waveform data is set as reference waveform data. Waveform data which matches the reference waveform data is extracted from the other waveform data. Interval information corresponding to the interval between the reference waveform data and the extracted waveform data is obtained, attaining information associated with the actual circumference.

Figure 16A:
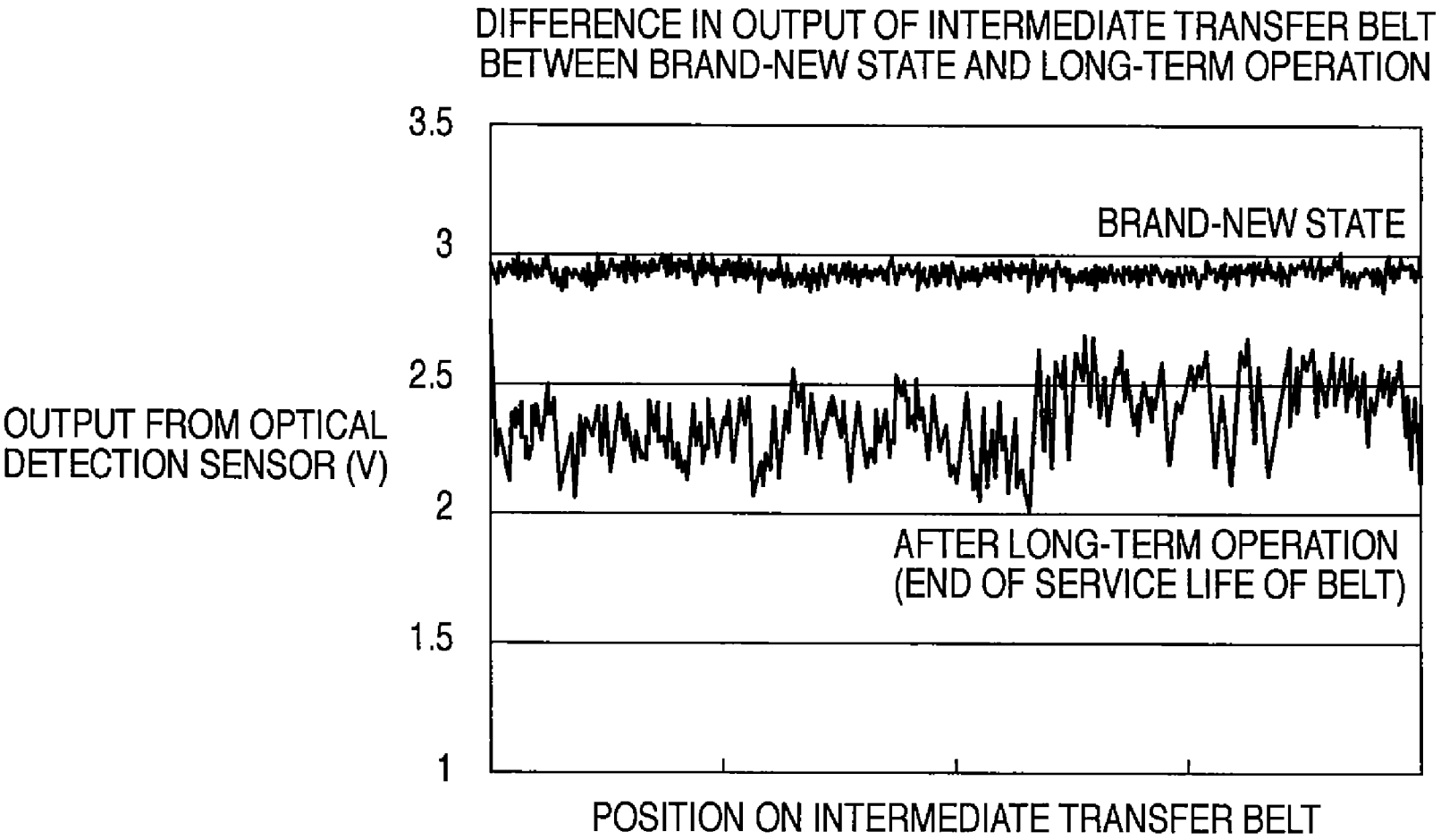
FIGS. 16A to 16C are views for explaining the difference between the circumference measurement method according to the first embodiment and a circumference measurement serving as a comparative example.
Figure 16B:
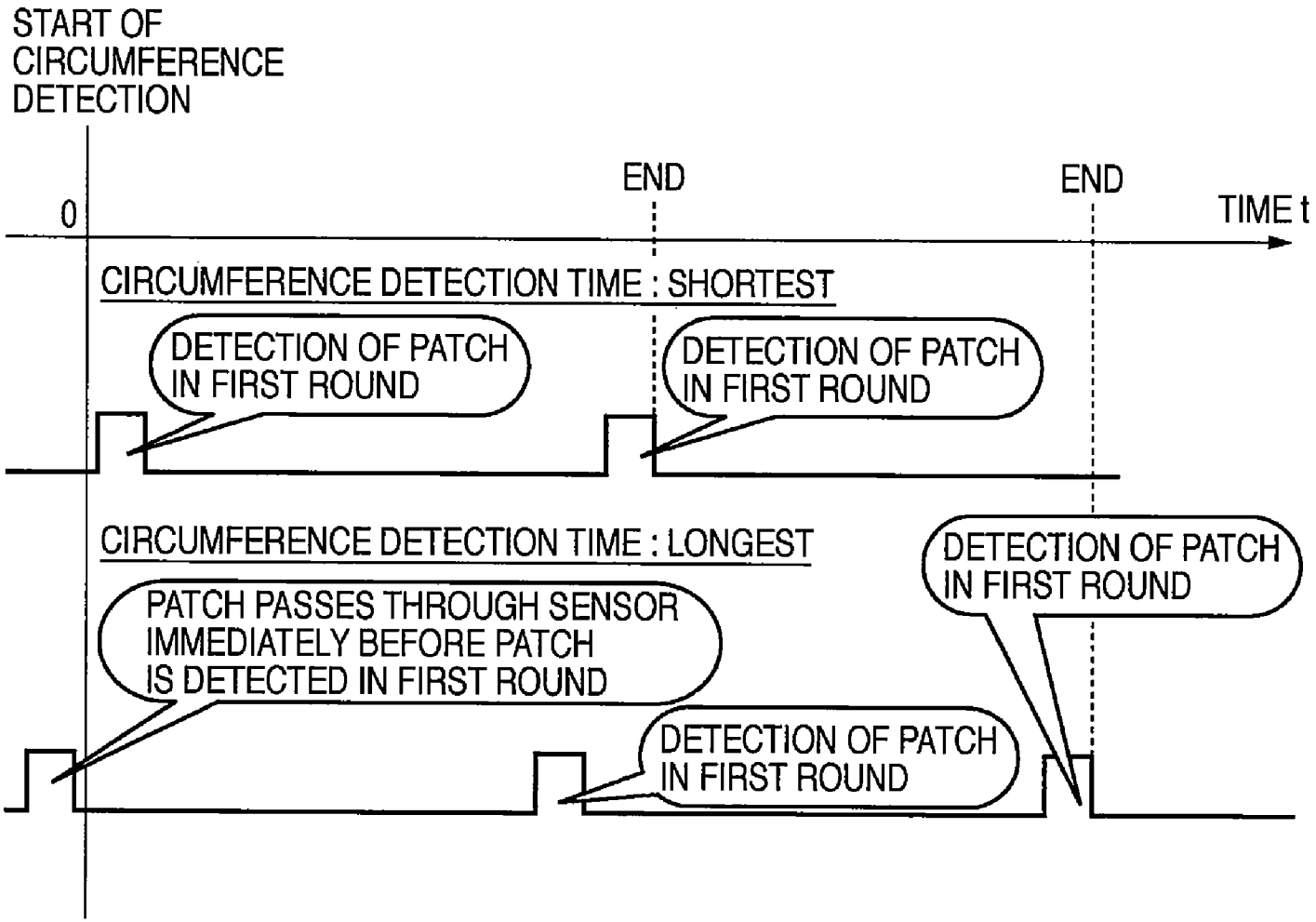
Figure 16C:
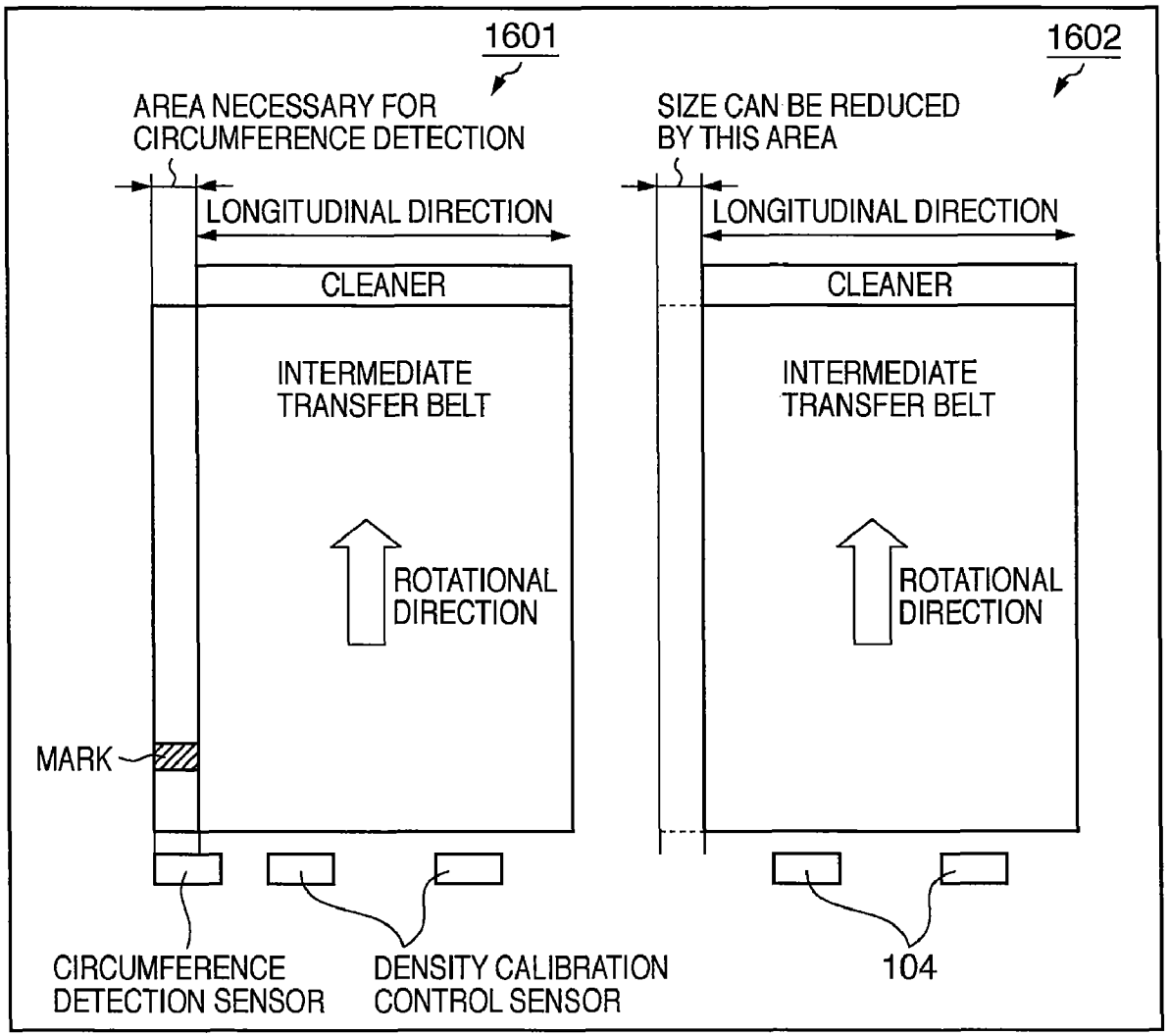

FIGS. 16A to 16C are views for explaining the difference between the circumference measurement method according to the first embodiment and a circumference measurement serving as a comparative example. FIG. 16A shows the position dependence of the intermediate transfer belt 31 when the light receiving element 302 receives light reflected by the background of the intermediate transfer belt 31. As shown in FIG. 16A, when the intermediate transfer belt 31 is new, background reflected light is almost uniform regardless of the position on the intermediate transfer belt 31. When the intermediate transfer belt 31 comes close to the end of its service life after long-term operation of the apparatus, background reflected light becomes nonuniform depending on the position on the intermediate transfer belt 31.

According to the circumference measurement method of the first embodiment, the circumference of the intermediate transfer belt 31 is obtained by detecting a portion where the waveform profiles of the first and second rounds coincide with each other. As nonuniformity of background reflected light depending on the position on the intermediate transfer belt 31 is larger, the reliability of the detection result becomes higher. Even if the intermediate transfer belt 31 changes over time, the circumference can be obtained.

FIG. 16B shows the timing when a patch is detected by the circumference measurement method serving as a comparative example. According to the circumference measurement method serving as a comparative example, a mark is attached to the surface of the intermediate transfer belt. The optical sensor receives light reflected by the mark, thereby measuring the circumference of the intermediate transfer belt.

As shown in FIG. 16B, in the circumference measurement method serving as a comparative example, the maximum time taken for circumference detection is the time taken for the intermediate transfer belt 31 to rotate two rounds at maximum. The circumference measurement method of the first embodiment can start circumference measurement at an arbitrary timing, and can shorten the time, compared to the comparative example. In other words, the circumference measurement method of the first embodiment can shorten the processing time taken to measure the circumference of the intermediate transfer belt 31.

The reason why the circumference measurement method according to the first embodiment is effective for downsizing the apparatus will be explained with reference to FIG. 16C. FIG. 16C shows the operation of the cleaner. An arrangement 1601 is necessary for circumference measurement by the comparative example. An arrangement 1602 is necessary for circumference measurement by the first embodiment.

In the comparative example, when the mark exists within a longitudinal range in the cleaning area of the cleaner in the arrangement 1601, the cleaner passes over the mark, degrading the cleaning performance of the cleaner. To prevent this, the mark must be arranged at a position where it does not overlap the longitudinal range in the cleaning area of the cleaner 33, as represented by the arrangement 1601. The circumference detection mark needs to be arranged at an end in the longitudinal direction. As a result, the comparative example cannot downsize the image forming apparatus. The circumference detection mark is generally set to a size of 8 to 10 mm in order to detect it by a circumference detection sensor even when the belt skews by a maximum amount. To the contrary, the circumference measurement method according to the first embodiment requires neither the circumference detection sensor nor mark, as represented by the arrangement 1602, and is advantageous for downsizing the apparatus.

Effects of First Embodiment

As described above, when a foreign substance is adhered to a driving roller for driving an endless belt, such as a facing roller, the first embodiment can properly evaluate the detection result of the optical sensor 104. Based on the evaluation result, the first embodiment can obtain a more accurate dynamic characteristic of the apparatus.

The expansion coefficient of the facing roller is, for example, 0.00003/° C. though it depends on the characteristic of the facing roller. This expansion coefficient hardly affects cycle variations of the facing roller. To the contrary, the influence of an adhered foreign substance is sometimes larger than that of the expansion coefficient. When such a foreign substance is adhered, the detection result needs to be evaluated appropriately in correspondence with the adhered foreign substance. The first embodiment can cope with even this case.

If a foreign substance is adhered to the facing roller, the radius of the roller increases at the portion where the foreign substance is adhered. As a result, the circumference of the facing roller changes. When the facing roller rotates once, the moving amount of the surface of an image carrier (e.g., intermediate transfer belt) driven by the facing roller changes to a non-negligible degree. In this case, a mechanism of obtaining the dynamic characteristic of the apparatus on the assumption that the circumference of the facing roller is constant cannot accurately attain the dynamic characteristic of the apparatus.

In contrast, the first embodiment accurately obtains ABSM in consideration of a foreign substance adhered to the facing roller. The first embodiment can attain information associated with the circumference of the image carrier as the dynamic characteristic of the apparatus at higher precision than that in the conventional method which does not consider variations of ABSM caused by adhesion of a foreign substance. Even if ABSM dynamically changes owing to the manufacturing tolerance, wear upon long-term operation, or the like, the first embodiment can flexibly cope with it. The first embodiment can use the changed ABSM to obtain information associated with the circumference of the image carrier as a more accurate dynamic characteristic of the apparatus.

As described in step S905 of FIG. 9A, information of a foreign substance on the facing roller is determined, preventing unnecessarily executing ABSM measurement. This can shorten the time of calibration (processing to obtain the dynamic characteristic of the apparatus). Even when a foreign substance is adhered to the facing roller, circumference measurement can be executed without decreasing the circumference measurement precision.

In FIG. 12, the sine wave represents the influence of the facing roller for easy understanding. In practice, an output from the optical sensor under the influence of the facing roller except for a foreign substance is not always ideal as shown in FIG. 12 owing to poor sensor precision, small eccentricity of the facing roller, or the like. In this case, the sine wave contains noise and detection errors of the optical sensor except for a detection signal influenced by an adhered foreign substance. It is difficult to calculate ABSM from detection signals free from the influence of the adhered foreign substance. To the contrary, in the processing of step S906 of FIG. 9A, a singularity representing the influence of a foreign substance adhered to the facing roller is extracted. Thus, ABSM can be easily obtained at high precision.

It is also possible to regard the influence of an adhered foreign substance as noise, exclude sampling data deviated by a predetermined amount, and use the average value of preceding and succeeding sampling data. More specifically, sampling data regarded as noise is removed by averaging from the eccentric component of the facing roller shown in FIG. 12 and the sampling result of FIG. 13.

However, sampling data reflecting the influence of an adhered foreign substance contains even the background component of the intermediate transfer belt 31. Removing sampling data reflecting the influence of an adhered foreign substance means removing the background component. For example, the influence of the background component of the intermediate transfer belt 31 may occupy half the output value of given deviated sampling data. If sampling data reflecting the influence of an adhered foreign substance is simply removed, this may influence the calculation processing in step S913, failing to obtain an accurate result. Particularly when the intermediate transfer belt 31 deteriorates (corresponding to, e.g., a sensor output after long-term operation in FIG. 16A), this problem becomes serious. In contrast, the first embodiment does not simply remove data reflecting the influence of an adhered foreign substance. The first embodiment can avoid the situation in which an accurate result fails to be obtained.

Second Embodiment

Figure 17:
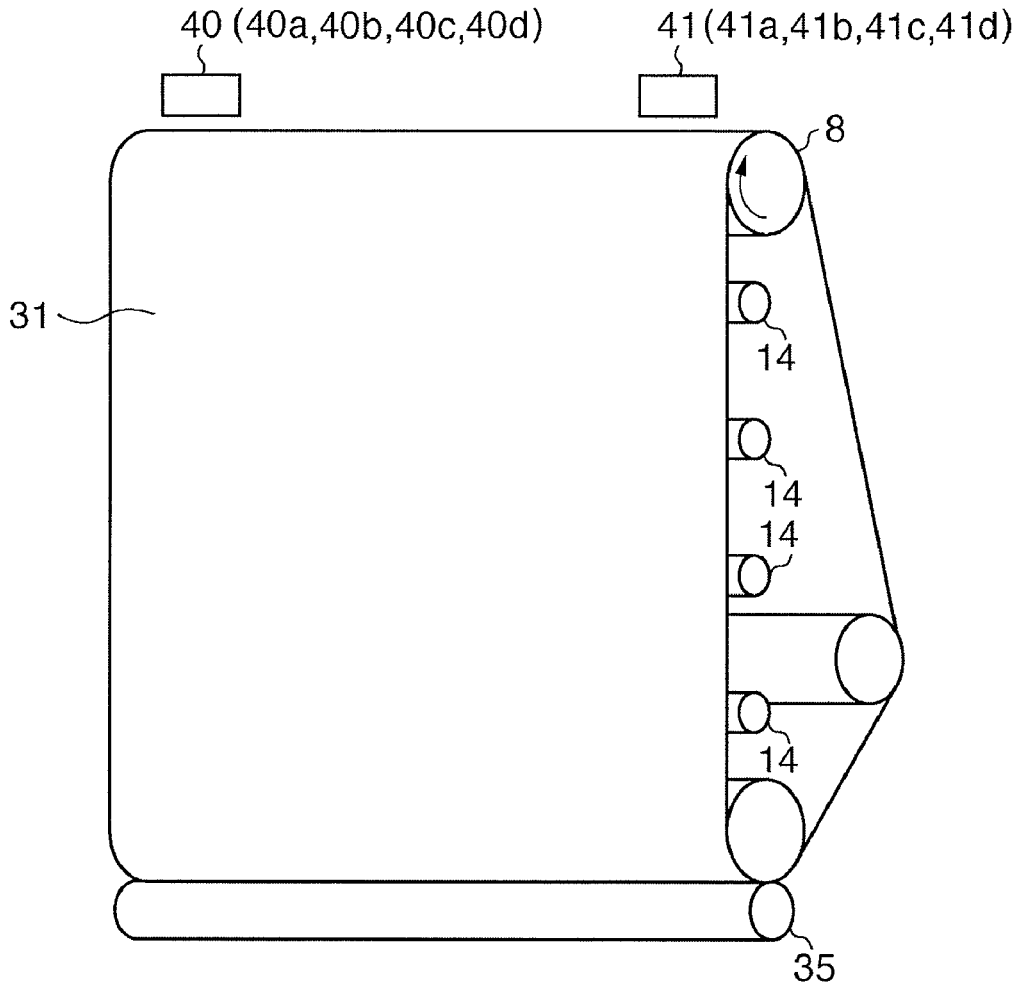
FIG. 17 is a schematic sectional view of an image forming apparatus according to the second embodiment.

The second embodiment will be explained with reference to FIGS. 17 and 18. FIG. 17 is a schematic sectional view of an image forming apparatus according to the second embodiment. In the image forming apparatus according to the second embodiment, optical sensors 40 and 41 for detecting surface information of an image carrier (intermediate transfer belt 31) are also used as color misregistration detection sensors. As shown in FIG. 17, the two optical sensors (first and second detectors) 40 and 41 are arranged in a direction perpendicular to the conveyance direction of the intermediate transfer belt 31.

The second embodiment adopts these two optical sensors. The two sensors detect foreign substance information described in the first embodiment. The profile circumference measurement operation is switched based on the detection result. In this regard, the second embodiment is superior to the first embodiment. The structure of the optical sensor 41 is the same as that of the optical sensor 40, and a description thereof will not be repeated.

The optical sensor 40 includes a light emitting element 40*a*, and light receiving elements 40*b* and 40*c*. The optical sensor 41 includes a light emitting element 41*a*, and light receiving elements 41*b* and 41*c*. A description of the same technique as that in the first embodiment will not be repeated, including the arrangement of the image forming apparatus except for the optical sensors, the structure of the optical sensor, and the image density calibration control method. Only features of the second embodiment will be explained.

Figure 18A:
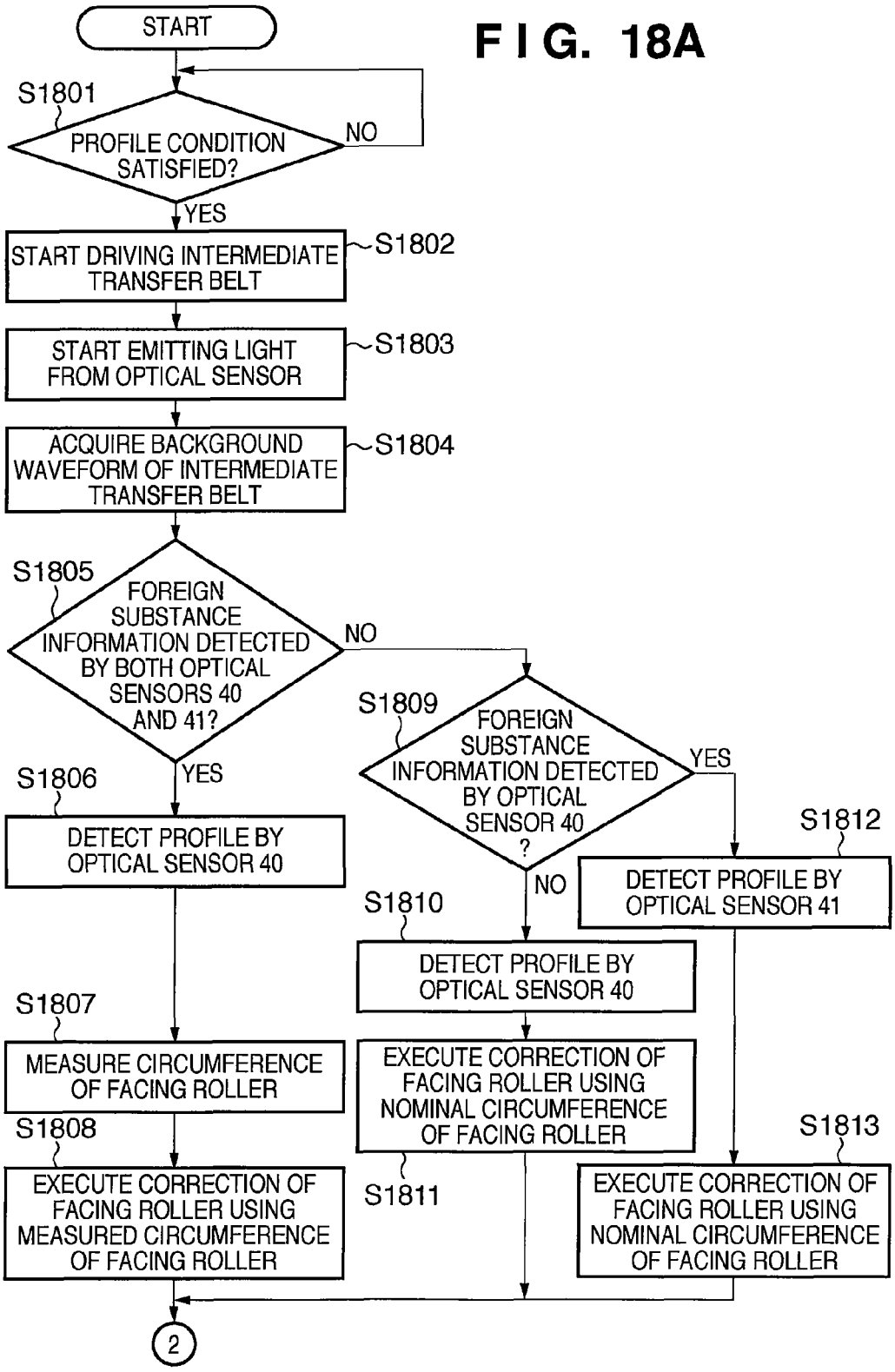
FIGS. 18A and 18B are flowcharts showing an intermediate transfer belt circumference measurement method according to the second embodiment.
Figure 18B:
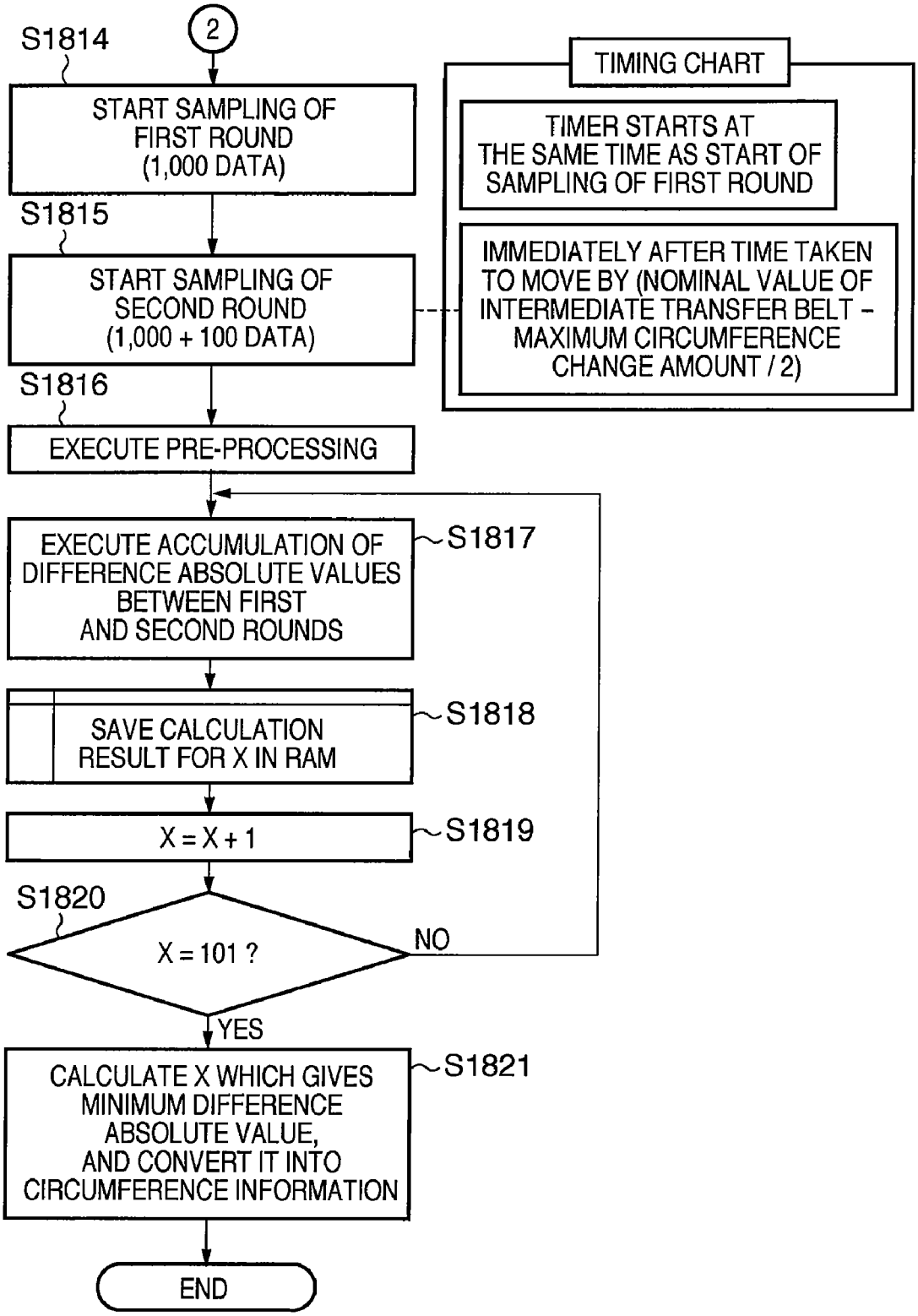

FIGS. 18A and 18B are flowcharts showing an intermediate transfer belt circumference measurement method according to the second embodiment. A CPU 101 executes the following processing by loading a control program stored in a ROM 102 into a RAM 103.

Steps S1801, S1802, and S1814 to S1821 are the same as steps S901, S902, and S910 to S917 in the first embodiment, and a description thereof will not be repeated. Only steps S1803 to S1813 as features of the second embodiment will be explained.

In step S1803, a circumference measurement unit 111 causes the light emitting elements 40*a* and 41*a* of the optical sensors 40 and 41 to emit the same quantities of light as those in image density calibration control. The light receiving elements 40*b* and 41*b* receive light components reflected by the intermediate transfer belt 31.

In step S1804, the circumference measurement unit 111 executes sampling of the background waveform of the intermediate transfer belt 31 using the optical sensors 40 and 41. The sampling in this step is executed to determine whether there is a foreign substance generated from a roller facing the optical sensors 40 and 41. The sampling area is the same as that in the first embodiment.

In step S1805, based on the acquisition result in step S1804, the circumference measurement unit 111 determines whether a foreign substance is adhered to the facing roller immediately below the optical sensors 40 and 41. The determination method is the same as that in step S905 of the first embodiment, and a description thereof will not be repeated. If both the optical sensors 40 and 41 determine that a foreign substance exists on the facing roller, the circumference measurement unit 111 executes profile detection using the optical sensor 40 in step S1806. In step S1807, the circumference measurement unit 111 executes ABSM measurement, and executes correction of the facing roller in step S1808 using the measured ABSM. When both the optical sensors 40 and 41 determine that a foreign substance exists on the facing roller, ABSM measurement takes about 9 sec.

If there is a case other than that in which both the optical sensors 40 and 41 have detected a foreign substance in step S1805, the circumference measurement unit 111 determines in step S1809 whether the optical sensor 40 has detected a foreign substance on the facing roller. If the optical sensor 40 has not detected a foreign substance, the circumference measurement unit 111 executes profile detection using the optical sensor 40 in step S1810. In step S1811, the circumference measurement unit 111 executes correction of the facing roller using the nominal ABSM. If the optical sensor 40 detects a foreign substance in S1809, the circumference measurement unit 111 executes profile detection using the optical sensor 41 in step S1812. In step S1813, the circumference measurement unit 111 executes correction of the facing roller using the nominal ABSM. According to the second embodiment, when either of the optical sensors 40 and 41 detects a foreign substance, profile detection is executed using the other optical sensor which has not detected the foreign substance.

As described above, according to the second embodiment, a plurality of optical sensors detects information of a foreign substance on the facing roller. Profile detection can be executed using an optical sensor which has not detected foreign substance information. The second embodiment can decrease the count at which the calibration time becomes long, compared to the first embodiment. Even when a foreign substance is adhered to the facing roller, the circumference can be measured without decreasing the circumference measurement precision.

Third Embodiment

The third embodiment will be explained with reference to FIGS. 19A and 19B. The third embodiment applies, to image density calibration control, the result of determining information of a foreign substance on a facing roller. In an image forming apparatus according to the third embodiment, optical sensors 40 and 41 are also used as color misregistration detection sensors, similar to the second embodiment. The two optical sensors 40 and 41 exist in a direction perpendicular to the conveyance direction of an intermediate transfer belt 31. The optical sensor 40 includes a light emitting element 40*a*, and light receiving elements 40*b* and 40*c*. The optical sensor 41 includes a light emitting element 41*a*, and light receiving elements 41*b* and 41*c*. A description of the same technique as that in the first embodiment will not be repeated, including the arrangement of the image forming apparatus except for the optical sensors, the structure of the optical sensor, and the image density calibration control method. Only features of the third embodiment will be explained.

Figure 19A:
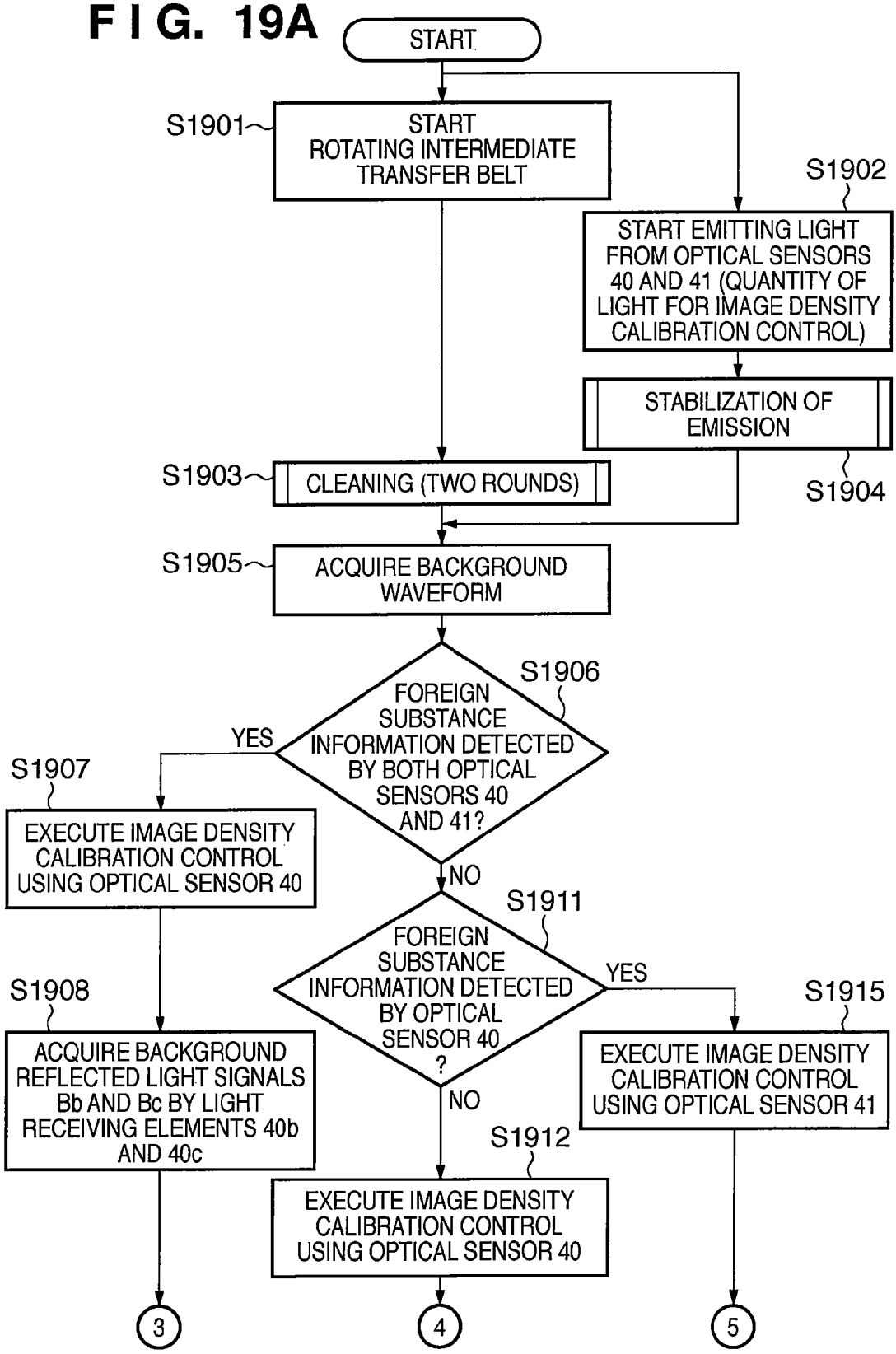
FIGS. 19A and 19B are flowcharts showing the processing sequence of an image calibration control method according to the third embodiment.
Figure 19B:
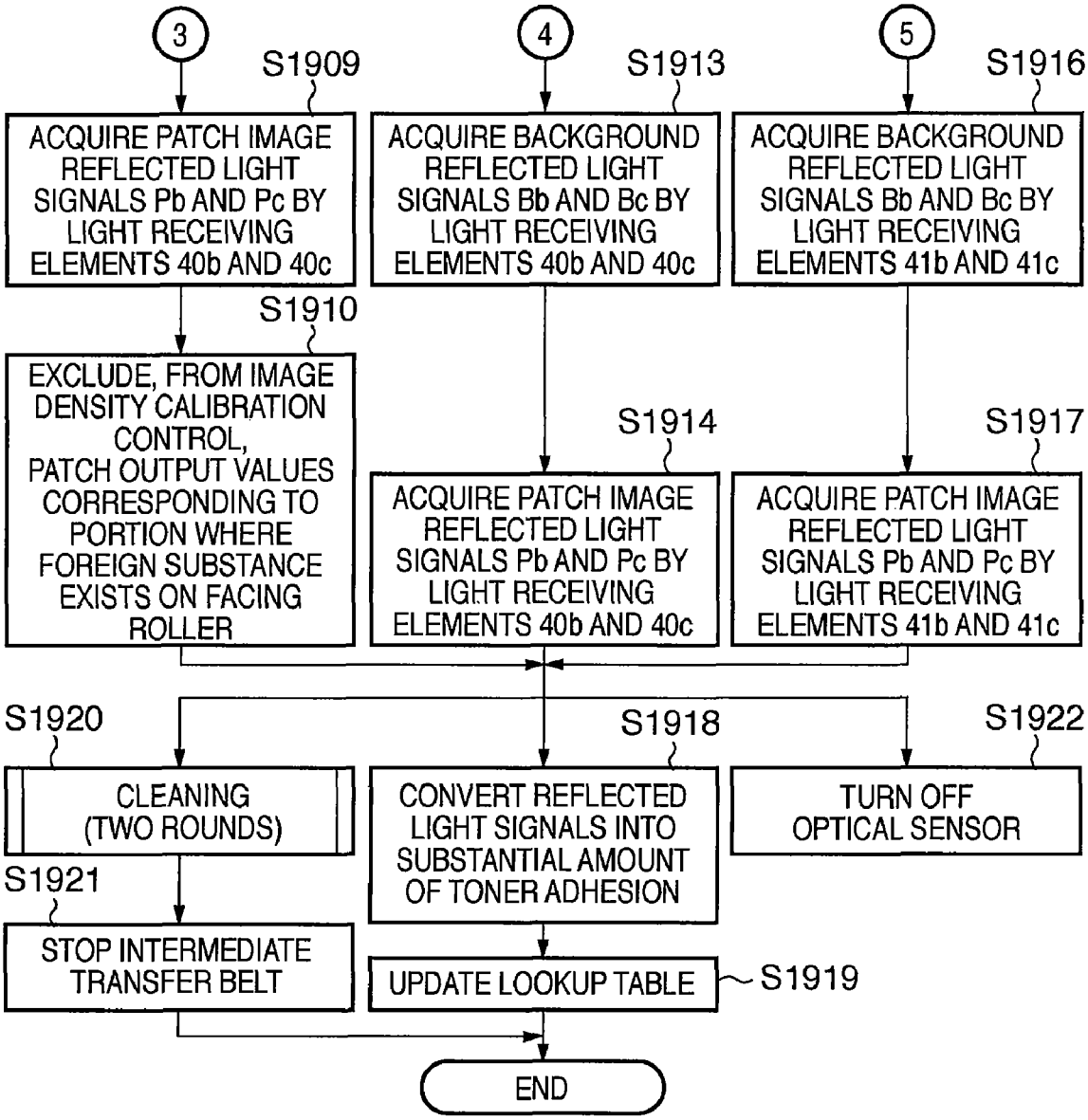

FIGS. 19A and 19B are flowcharts showing the processing sequence of an image calibration control method according to the third embodiment. Processes in steps S1901 to S1904 are the same as those in steps S501 to S504 except that the third embodiment employs a plurality of optical sensors.

In step S1905, a density calibration control unit 112 executes sampling of the background waveform of the intermediate transfer belt 31 using the optical sensors 40 and 41. The sampling in this step is executed to determine whether there is a foreign substance generated from a roller facing the optical sensors 40 and 41. The sampling area is the same as those in the first and second embodiments.

In step S1906, based on the acquisition result in step S1905, the density control calibration unit 112 determines whether a foreign substance is adhered to the facing roller immediately below the optical sensors 40 and 41. The determination method is the same as that in step S905 of the first embodiment, and a description thereof will not be repeated. If both the optical sensors 40 and 41 determine that a foreign substance exists on the facing roller, the density control calibration unit 112 executes image density calibration control using the optical sensor 40 in step S1907. In step S1908, the density control calibration unit 112 starts acquiring reflected light signals Bb and Bc from the light receiving elements 40*b* and 40*c* for light reflected by the background of the intermediate transfer belt 31. In step S1909, the density control calibration unit 112 starts acquiring reflected light signals Pb and Pc from the light receiving elements 40*b* and 40*c* for light reflected by a patch image. Both the optical sensors 40 and 41 have determined that a foreign substance exists on the facing roller. Thus, in step S1910, the density control calibration unit 112 excludes, from calculation of image density calibration control, outputs from the light receiving elements 40*b* and 40*c* that correspond to the portion where the foreign substance exists on the facing roller. This can prevent a decrease in image density calibration control precision owing to the foreign substance on the facing roller.

If the density control calibration unit 112 does not determine in S1906 that both the optical sensors 40 and 41 have detected a foreign substance on the facing roller, the process advances to step S1911. In step S1911, the density control calibration unit 112 determines whether a foreign substance is adhered to a portion of the facing roller immediately below the optical sensor 40.

If the optical sensor 40 has not detected a foreign substance on the facing roller, the density control calibration unit 112 executes image density calibration control using the optical sensor 40 in step S1912. The third embodiment assumes a case wherein neither the optical sensor 40 nor 41 has detected a foreign substance on the facing roller, and a case wherein the optical sensor 40 has not detected a foreign substance but the optical sensor 41 has detected it. In step S1913, the density control calibration unit 112 starts acquiring the reflected light signals Bb and Bc from the light receiving elements 40*b* and 40*c* for light reflected by the background of the intermediate transfer belt 31. In step S1914, the density control calibration unit 112 starts acquiring the reflected light signals Pb and Pc from the light receiving elements 40*b* and 40*c* for light reflected by a patch image.

If the optical sensor 40 has detected a foreign substance on the facing roller in S1911, the density control calibration unit 112 executes image density calibration control using the optical sensor 41 in step S1915. In step S1916, the density control calibration unit 112 starts acquiring the reflected light signals Bb and Bc from the light receiving elements 41*b* and 41*c* for light reflected by the background of the intermediate transfer belt 31. In step S1917, the density control calibration unit 112 starts acquiring the reflected light signals Pb and Pc from the light receiving elements 41*b* and 41*c* for light reflected by a patch image.

After the end of the process in step S1910, S1914, or S1917, the process advances to step S1918. Processes in steps S1918 to S1922 are the same as those in steps S507 to S511, and a description thereof will not be repeated.

As described above, according to the third embodiment, a plurality of optical sensors detects information of a foreign substance on the facing roller. Image density calibration control can be performed using an optical sensor which has not detected foreign substance information. The third embodiment can prevent a decrease in calibration precision influenced by a foreign substance adhered to the facing roller. Even when all arranged optical sensors detect a foreign substance on the facing roller, patch outputs corresponding to a portion where the foreign substance exists are excluded from calculation of image density calibration control based on information of the foreign substance on the facing roller. This can prevent a decrease in image density calibration control precision. In the third embodiment, an output corresponding to a portion where a foreign substance exists is excluded from calculation of image density calibration control. However, the same result as that in the third embodiment can also be obtained by forming a patch only at a portion where no foreign substance exists, and performing image density calibration control.

Fourth Embodiment

Figure 20:
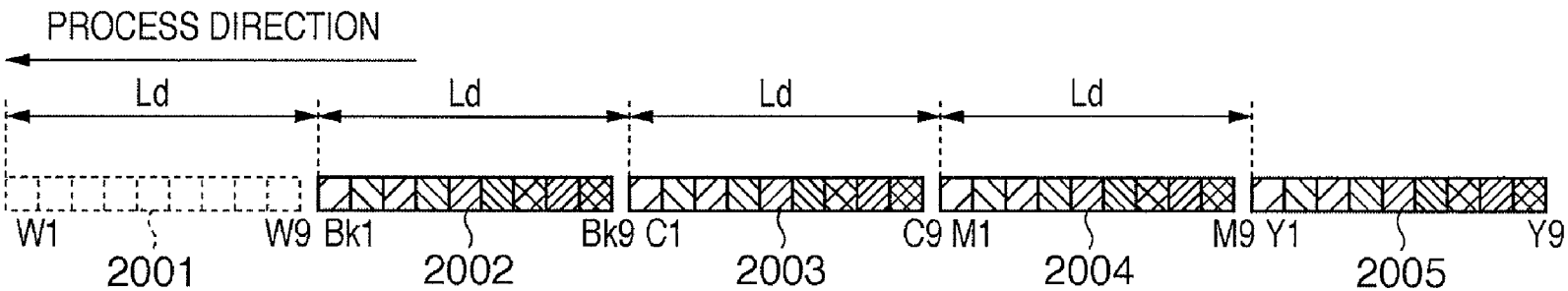
PRIOR ART FIG. 20
FIG. 20 is a view for explaining a patch image measurement method in conventional image density calibration control.

The fourth embodiment will be explained with reference to FIG. 20. The fourth embodiment will explain a case wherein the present invention is applied to conventional image density calibration control. FIG. 20 is a view for explaining a patch image measurement method in the conventional image density calibration control.

In FIG. 20, reference numeral 2001 denotes a toner absence portion; and 2002 to 2005, patch images formed with black, cyan, magenta, and yellow toners, respectively. As shown in FIG. 20, a set of patch images (patch pattern) includes the toner absence portion 2001 corresponding to one circumference of a facing roller. Distances Ld between the starts of the respective patch images 2002 to 2005 are set to 92.0 mm, which is equal to the nominal circumference value of the facing roller. The patch pattern is formed from the toner absence portion 2001, black patch image 2002, cyan patch image 2003, magenta patch image 2004, and yellow patch image 2005 in the order named.

In image density calibration control executed by forming a patch image in the above-described way, the density measurement value of the patch image is corrected by measuring a detection error in each phase of the facing roller. This utilizes the fact that a detection error arising from a foreign substance adhered to the facing roller depends on the size and shape of the foreign substance, and occurs at almost the same ratio (cyclically) every time the facing roller rotates. In the image density calibration control, the toner absence portion 2001 corresponding to one circumference of the facing roller is arranged upstream in the process direction of the color patch pattern. Patch image data is converted based on the data of the toner absence portion 2001, obtaining an almost ideal value.

A concrete conversion method will be explained by exemplifying toner density measurement of the yellow patch image 2005. Y(n) represents a normalized sensor output of the nth patch image that is obtained by measuring the above-mentioned patch image. W(n) represents a normalized sensor output of a position corresponding to the nth patch (=in phase on the facing roller) at the toner absence portion. In this case, the normalized sensor output Y(n)' of the nth patch image after correction is given by Y(n)'=Y(n)/W(n). According to this equation, image density calibration control is executed using corrected outputs of all the four colors from an optical sensor 40. This can cancel variations of the quantity of light reflected by the background of the belt. This can also cancel an error of the reflected light quantity influenced by a foreign substance or the like on the roller facing the sensor.

However, in this image density calibration control, the distance between the starts of respective color patches is fixed to only the ideal value (nominal value) of the circumference of the facing roller. If the circumference of the facing roller varies, the precision decreases. For example, as the patch image formation position moves apart from the toner absence portion 2001, ABSM errors may be accumulated, resulting in poor correction precision. That is, when the circumference of the facing roller varies, phase locking in the image density calibration control cannot be controlled appropriately, failing to cancel the influence of the facing roller. For example, in the patch pattern shown in FIG. 20, it becomes difficult to cancel the influence of the facing roller on the yellow patch image 2005 farthest from the toner absence portion 2001.

However, the present invention can be applied to solve this problem even in the above-described image density calibration control method. More specifically, before executing image density calibration control, it is determined whether a foreign substance exists on the facing roller, as described in the embodiments. When it is determined that a foreign substance exists, the circumference (e.g., nominal circumference) of the facing roller that is stored in the memory in advance is updated to one measured using the above-mentioned facing roller circumference measurement method. The processing to update the circumference has been described with reference to the flowcharts of FIGS. 9A and 9B in the first embodiment, and a detailed description thereof will not be repeated. The updated circumference is used to form a patch pattern at the updated formation interval, and update a lookup table associated with the image density serving as a dynamic characteristic of the apparatus. As a result, the present invention can suppress the influence of an adhered foreign substance on the facing roller.

If it is determined that no foreign substance exists, a patch pattern is formed using the circumference of the facing roller that is stored in the memory in advance. Then, the lookup table associated with the image density serving as a dynamic characteristic of the apparatus is updated.

As described above, according to the fourth embodiment, the optical sensor detects information of a foreign substance on the facing roller. If it is determined that a foreign substance is adhered, the distance between the starts of respective color patches is set as a measured circumference of the facing roller. This can suppress a decrease in correction precision even for the yellow patch image 2005 farthest from the toner absence portion 2001. If it is determined that there is no information of a foreign substance on the facing roller, no ABSM measurement is executed, shortening the calibration time.

Other Embodiments

The waveform profile is calculated by accumulating difference absolute values. Instead, the circumference of a rotation member may also be obtained by calculating a standard deviation. The measured circumference of a rotation member is used for image density calibration control in the above-described embodiments, but may also be used for color misregistration calibration control.

More specifically, a case wherein a circumference measurement unit 111 performs calculation based on a standard deviation will be explained by exemplifying the first embodiment. An equation at this time is $$xi = V_{first\ round}(i) - V_{second\ round}(i + x) \tag{8}$$

$$\sigma = \sqrt{\frac{n\sum\left(\begin{matrix} V_{first\ round}(i) - \\ V_{second\ round}(i+X) \end{matrix}\right)^2 - \left(\sum\left(\begin{matrix} V_{first\ round}(i) - \\ V_{second\ round}(i+X) \end{matrix}\right)\right)^2}{n(n-1)}}$$

where n is the number of samples, and σ is the standard deviation value. Since the number Xi of samples=1,000, n=1,000. The remaining variables have been explained in the first embodiment.

For X=0, 1, 2, . . . , 100, X which gives a minimum σ is extracted. After extracting X, information associated with the actual circumference is obtained similarly to the first embodiment. It will readily occur to those skilled in the art to apply equation (8) employing the standard deviation to the second to fourth embodiments.

The above-described embodiments have exemplified an ITB image forming apparatus, but the present invention is also applicable to an ETB image forming apparatus. In this case, the circumference detection target is not the intermediate transfer belt 31 but an electrostatic attraction conveyance belt (transfer belt).

The present invention can provide an image forming apparatus which accurately obtains the dynamic characteristic of the apparatus when a foreign substance is adhered to a driving roller for driving an endless belt, such as a facing roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-138781 filed May 27, 2008, which is hereby incorporated by reference herein in its entirety.

What is claimed is:

1. An image forming apparatus that forms a toner image on an endless belt driven by a driving roller, the apparatus comprising:

a detector that detects light from the endless belt or the toner image formed on the endless belt;

a determination unit that determines whether a foreign substance is adhered to the driving roller;

a decision unit that, in the case where said determination unit determines that the foreign substance is adhered, decides a moving amount of a surface of the endless belt when the driving roller rotates once by a first decision method deciding the moving amount and corresponding to a case wherein the foreign substance is adhered, and in the case where said determination unit determines that no foreign substance is adhered, decides the moving amount by a second decision method deciding the moving amount and corresponding to a case wherein no foreign substance is adhered; and a calculator that calculates a dynamic characteristic of the image forming apparatus based on a detection result of said detector that complies with the moving amount decided by said decision unit according to the first decision method or the second decision method.

2. The apparatus according to claim 1, further comprising a measurement unit that measures the moving amount of the surface of the endless belt when the driving roller rotates once, wherein the first decision method includes a method using said measurement unit to measure the moving amount of the surface of the endless belt when the driving roller rotates once.

3. The apparatus according to claim 2, wherein said measurement unit includes a sensor arranged to face the driving roller, and the first decision method decides the moving amount by extracting a singularity exceeding a threshold from results detected from the endless belt while the driving roller rotates a plurality of number of times, and obtaining a cycle of the extracted singularity.

4. The apparatus according to claim 1, wherein the second decision method decides the moving amount by reading out information of the moving amount being stored in advance in a storage unit.

5. The apparatus according to claim 1, wherein said detector includes a first detector and second detector that detects light reflected by the surface of the endless belt, wherein in the case where said determination unit determines, from a detection result of said first detector, that the foreign substance is adhered, and determines, from a detection result of said second detector, that the foreign substance is adhered, said decision unit decides the moving amount using the first decision method.

6. The apparatus according to claim 5, wherein said calculator calculates the dynamic characteristic of the image forming apparatus by using said first detector or said second detector that has output a detection result from which said determination unit determines that no foreign substance is adhered.

7. The apparatus according to claim 1, wherein the dynamic characteristic of the image forming apparatus includes information associated with a circumference of the endless belt.

8. The apparatus according to claim 1, further comprising:

a first acquisition unit that acquires, based on detection of said detector, first waveform data of an image-formed surface of the endless belt that is used to form an image; and a second acquisition unit that acquires, based on detection of said detector, second waveform data of the image-formed surface of the endless belt that is used to form an image, the second waveform data being detected from at least part of a detected section of the surface of the endless belt from which the first waveform data has been detected, wherein said calculator calculates information associated with a circumference of the endless belt based on matching between the acquired first waveform data and second waveform data.

9. The apparatus according to claim 1, wherein the dynamic characteristic of the image forming apparatus includes toner density.

10. An image forming apparatus that forms a toner image on an endless belt driven by a driving roller, the apparatus comprising:

an update unit that updates a moving amount of a surface of the endless belt when the driving roller rotates once, the moving amount being stored in advance in a storage unit of the image forming apparatus; and a calculator that calculates a dynamic characteristic of the image forming apparatus based on the moving amount updated by said update unit.

11. An image forming apparatus that forms a toner image on an endless belt driven by a driving roller, the apparatus comprising:

a first detector and second detector that detect light reflected by a surface of the endless belt;

a determination unit that determines, based on detection results of said first detector and said second detector, whether a foreign substance is adhered to the driving roller; and a calculator that causes a detector which obtains a detection result from which said determination unit determines that no foreign substance is adhered, to detect light reflected by the surface of the endless belt, and calculate a dynamic characteristic of the image forming apparatus based on the detection result of said detector.

* * * * *